US005680818A

United States Patent [19]

Tomiki et al.

[11] Patent Number: 5,680,818

[45] Date of Patent: Oct. 28, 1997

[54] APPARATUS AND SYSTEM FOR REMOVING DUST FROM PRINTING PLATE OF PRINTING PRESS

[75] Inventors: Yasuhiko Tomiki; Toshiyuki Ogiwara; Tadami Yoshimura, all of Tokyo; Kenichi Mizuno, Kanagawa; Kunio Idogawa, Kanagawa; Yoshihiro Nomura, Kanagawa; Tadashi Suzuki, Kanagawa, all of Japan

[73] Assignee: Dai Nippon Printing Co., Ltd., Tokyo, Japan

[21] Appl. No.: 406,888

[22] PCT Filed: Jul. 8, 1994

[86] PCT No.: PCT/JP94/01122

§ 371 Date: Mar. 1, 1995

§ 102(e) Date: Mar. 1, 1995

[87] PCT Pub. No.: WO95/01877

PCT Pub. Date: Jan. 19, 1995

[30] Foreign Application Priority Data

| | | | |
|---|---|---|---|
| Jul. 8, 1993 | [JP] | Japan | 5-042621 |
| Aug. 10, 1993 | [JP] | Japan | 5-216936 |
| Aug. 10, 1993 | [JP] | Japan | 5-216937 |
| Aug. 10, 1993 | [JP] | Japan | 5-216939 |

[51] Int. Cl.[6] ..... B41F 35/00

[52] U.S. Cl. ..... 101/425; 101/423

[58] Field of Search ..... 101/425, 423, 101/424; 15/256.53, 256.52, 256.51

[56] References Cited

U.S. PATENT DOCUMENTS

| | | | |
|---|---|---|---|
| 4,457,738 | 7/1984 | Gross et al. | 400/144.2 |
| 4,499,827 | 2/1985 | Takeuchi | 15/256.53 |
| 5,148,746 | 9/1992 | Fuller et al. | 101/425 |
| 5,223,041 | 6/1993 | Cerney | 101/423 |
| 5,255,606 | 10/1993 | Iijima et al. | 101/425 |
| 5,385,096 | 1/1995 | Suzuki | 101/425 |

FOREIGN PATENT DOCUMENTS 557881 3/1993 Japan .

*Primary Examiner*—Edgar S. Burr
*Assistant Examiner*—Anthony H. Nguyen
*Attorney, Agent, or Firm*—Dvorak & Orum

[57] ABSTRACT

A printing-plate dust removing apparatus includes a guide rail 12 provided in parallel with a plate cylinder 1; a slider 13 moving along the guide rail 12; a holder 18 supported by the slider 13; a moving member 19 supported by the holder 18, the moving member 19 having a plurality of dust removing blades 28; and a driving gear for shifting the moving member 19 intermittently. A driving shaft 38 of the driving gear is connected with a driven shaft 27 through coupling members 41 and 42. Interlocking claws 41A and 42A of the coupling members are set so that the coupling members are engaged with each other at a standby position of the dust removing blades. Also, the holder 119 and the slider 113 are connected with each other by wedge members 138 and 144 so that the wedge members are firmly engaged with each other by a clamping bolt 147 and a holder plate 140. A printing-plate dust removing system 205 includes the above printing-plate dust removing apparatus and a controller 231, in which the controller compares a presumed position which is now in recognition and an actual position based on a signal c input from a detecting sensor 242 for detecting the position of the slider 206 so that both the positions are coincided with each other. The controller 309 shifts the moving member 208 (dust removing belt 210) only when a signal informing that the dust removing blade 211 is located at the standby position is inputted from a blade position detecting device 308, and then it shifts the slider 206.

15 Claims, 26 Drawing Sheets

APPARATUS AND SYSTEM FOR REMOVING DUST FROM PRINTING PLATE OF PRINTING PRESS

FIELD OF THE INVENTION

The present invention relates to a dust removing apparatus and system for removing ink or paper dust from a printing plate of a printing press.

DESCRIPTION OF THE BACKGROUND ART

In printing process with various types of printing presss, ink or paper dust adheres to a printing plate during printing, and it causes pinhole-shaped blank areas called hiekeys on prints. For this reason, it is necessary to remove dust from a printing plate of a printing press during printing or at its idle time.

In this regard, there has been proposed a printing-plate dust removing apparatus, as disclosed in Japanese laid-open Patent Application No. 5-57881, including a guide member provided along a plate cylinder; a slider moving along the guide member; a holder supported by the slider; a moving member supported by the holder, which has a plurality of dust removing blades arranged with predetermined pitches; and a driving gear for shifting the moving member intermittently.

In this dust removing apparatus, the holder supporting the moving member is shifted along the plate cylinder together with the slider to be located at a specified position for dust removing, and then, the moving member is located at a working position where one of the dust removing blades is opposite to the plate cylinder so that dust removing can be carried out. After dust removing, the moving member shifts to a standby position where the corresponding dust removing blade is not opposite to the plate cylinder and then stops. Subsequently, whenever a dust removing operation is required, the moving member is again shifted intermittently between the above working position and standby position so that one of the dust removing blades adjacent to the previous one is opposite to the plate cylinder in order.

In addition, this dust removing apparatus requires a replacement of a moving member with a new one after using all the dust removing blades on the moving member.

In the conventional printing-plate dust removing apparatus, the driving gear has a driving source (e.g. stepping motor) placed in a machine mount on which the guide member is installed so as to transmit power from the driving source to the moving member through a power transmission mechanism. The power transmission mechanism, however, is directly connected to the holder or the moving member which has been set on the holder, and this results in an extremely complicated dismantling procedure to remove the holder with the moving member from the slider.

An object of this invention according to claim 1 is to provide an apparatus for removing dust from a printing plate of a printing press which achieves an easier removal or installation work of a holder from or into a slider so as to solve the above problem.

The conventional apparatus also requires initializing a position of the moving member, which sets dust removing blades on a new moving member at a position which is not opposite to the plate cylinder whenever the moving member has been changed, and this leads to inferior replacement workability.

An object of the invention according to claim 2 is to provide an apparatus for removing dust from a printing plate of a printing press including a replaceable moving member with a plurality of dust removing blades, which has a compact apparatus configuration and achieves an improved replacement workability of the moving member.

Also, in the above conventional printing-plate dust removing apparatus, a holder must be firmly attached to a slider and they are required to be easily removed and installed.

The invention according to claim 3 is provided in consideration of the above condition, and an object of the invention is to provide an apparatus for removing dust from a printing plate of a printing press in which a holder of a dust removing head can be removed from or installed on a slider easily and securely.

An object of the invention according to claim 4 is to provide an apparatus for removing dust from a printing plate of a printing press in which an attachment of a holder to a slider is secured in the process of attachment.

An object of the invention according to claim 5 is to provide an apparatus for removing dust from a printing plate of a printing press in which a dust removing head can be easily assembled and disassembled.

An object of the invention according to claim 6 is to provide an apparatus for removing dust from a printing plate of a printing press in which a dust removing head can be easily installed in a narrow gap between rollers including a plate cylinder by using a narrower dust removing head.

An object of the invention according to claim 7 is to provide an apparatus for removing dust from a printing plate of a printing press in which a dust removing head can be easily installed in or removed from a narrow gap between rollers including a plate cylinder, and a dust removing belt (timing belt) is prevented from striking each other so as to achieve a smooth operation of the belt.

Furthermore, in the conventional printing-plate dust removing apparatus, the guide member (guide rail) for shifting the slider is exposed to the outside and the guide member stained with ink may cause a slider shift error.

An object of the invention according to claims 8 and 9 is to provide an apparatus for removing dust from a printing plate of a printing press in which a guide member (guide rail) and a slider are prevented from being stained with ink so as to achieve a smooth shift of the slider.

In the conventional printing-plate dust removing apparatus, it is not detected whether one of the dust removing blades of the moving object is located at an working position which is in contact with the printing plate or at an standby position which is isolated from the printing plate, so that the dust removing blade may not be properly in contact with the printing plate in a dust removing operation, which may reduce the reliability on dust removing.

An object of the invention according to claim 10 is to provide a reliable system for removing dust from a printing plate of a printing press which enables improved reliability of dust removing.

In the conventional printing-plate dust removing apparatus, it is not detected whether one of the dust removing blades of the moving member is located at an working position which is in contact with the printing plate or at an standby position which is isolated from the printing plate, so that the dust removing blade may strike and damage against the printing plate during a slider shifting operation.

An object of the invention according to claim 11 is to provide a system for removing dust from a printing plate of a printing press in which dust removing blades do not damage the printing plate.

In the conventional printing-plate dust removing apparatus, the dust removing head is set to a target position on the plate cylinder by moving the slider, on which the dust removing head is mounted, along the guide member, so that ink or other dust on the printing plate can be removed. The above slider is shifted by a moving device controlled by a controller. The controller presumes a position of the slider on the basis of movement from a reference position and it sets the slider to the target position based on the presumed position.

Since the controller, however, only presumes the slider position, if the presumed position is not the same as an actual position of the slider, the slider cannot be set exactly to the target position. As a result, it may fail in setting the dust removing head of the printing-plate dust removing apparatus exactly to a desired position on the plate cylinder.

Therefore, the invention according to claim 12 is to provided in consideration of the above condition and an object of the invention is to provide a system for removing dust from a printing plate of a printing press in which a slider can be exactly set to a target position.

An object of the invention according to claim 13 is to provide a system for removing dust from a printing plate of a printing press in which a dust removing head stops at a position over which ink will not be scattered intensively so that a shifting operation of a slider and a dust scraping operation of the dust removing head can be smoothly performed.

An object of the invention according to claim 14 is to provide a system for removing dust from a printing plate of a printing press in which the number of times dust removing blades have been used can be exactly determined at any time so as to improve reliability of dust scraping by use with the dust removing blades.

An object of the invention according to claim 15 is to provide an apparatus for removing dust from a printing plate of a printing press using a narrower dust removing head.

DISCLOSURE OF THE INVENTION

The invention of claim 1 provides an apparatus for removing dust from a printing plate of a printing press comprising a guide member supported by a machine mount, being installed in parallel with a plate cylinder axis along a circumferential surface of the plate cylinder; a slider for movement along the guide member; a holder supported by the slider; a moving member supported by the holder, the moving member having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during the other time; wherein the holder is removably supported by the slider and the driving gear includes a driving shaft supported by the machine mount or the slider, a driven shaft supported by the holder, and a connecting member for connecting the driven shaft with the driving shaft.

According to the invention of claim 1, the driving shaft supported by the machine mount or the slider is connected with the driven shaft supported by the holder through the connecting member, so that the driving shaft can be easily isolated from the driven shaft by using the above connecting member when the holder is detached from the slider. When the holder is attached to the slider, the driven shaft can be easily connected with the driving shaft through the connecting member. This simplifies a process of attaching or detaching the holder to or from the slider.

The invention of claim 2 provides an apparatus for removing dust from a printing plate of a printing press according to claim 1, wherein the connecting member further includes a driving shaft coupling member provided on the slider and a driven shaft coupling member provided on the holder, and a setting position for interlocking claws of the both coupling members is determined so that the driven-side coupling member can be engaged with the driving-side coupling member only at a predetermined standby position where the corresponding dust removing blade is isolated from the plate cylinder in the condition that an intermittent rotation of the driving shaft is stopped.

According to the invention of claim 2, the position of the moving object is always managed by the driving gear. In other words, the moving object is alternately placed at an working position and a standby position by the driving gear. For this reason, a detector need not be attached to the holder, etc. of the moving object to detect the current position of the corresponding dust removing blade on the moving object, so that a compact configuration of the apparatus can be achieved.

The driving-side coupling member is stopped at a position where the moving object is placed at a standby position without fail in the condition that the intermittent rotation of the driving shaft is stopped. By specifying the setting position for the interlocking claws of the driving-side coupling member and the driven-side coupling member as described above, a driven-side coupling member on a new moving object is engaged with the above driving-side coupling member only at an interlocking position where the moving object is located at a standby position. Accordingly, when the moving object is exchanged together with the holder, the corresponding dust removing blade on the moving object can be automatically set at a position not opposite to the plate cylinder (standby position) without fail only by engaging the driven-side coupling member with the driving-side coupling member.

The invention of claim 3 provides an apparatus for removing dust from a printing plate of a printing press according to claim 1, wherein the holder is removably interlocked with the slider through wedge members and the holder has a configuration wherein a receiving member provided on the holder is fixed through a clamping member on the slider by pressure in a direction that the wedge members are firmly fitted.

According to the invention of claim 3, it has a configuration in which the holder is fitted on the slider through the wedge members and it is connected through the clamping member so that the above wedge members are firmly fitted by clamping of the clamping member, therefore, the wedge members can be easily fitted and released, respectively, by fixing and releasing the clamping member. In addition, the slider is connected with the holder by fitting the wedge members to clamp the clamping member, so that the connection can be performed securely. As a result, the holder of the dust removing head can be easily and securely attached to or detached from the slider.

The invention of claim 4 provides an apparatus for removing dust from a printing plate of a printing press according to claim 3, wherein the receiving member is a holder plate for guiding the clamping member when the holder is attached or detached, and the holder plate has a member for holding the clamping member.

According to the invention of claim 4, the holder plate is equipped with the member for preventing the clamping member from falling off, so that the clamping member can be held in the holder plate, and the holder with the holder plate can be securely attached to the slider with the clamping member.

The invention of claim 5 provides an apparatus for removing dust from a printing plate of a printing press comprising a guide member supported by a machine mount, being installed in parallel with a plate cylinder axis along a circumferential surface of the plate cylinder; a slider for movement along the guide member; a holder supported by the slider; a moving member supported by the holder, the moving member having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during the other time; wherein the moving member is in the form of a belt having a plurality of dust removing blades arranged with predetermined pitches, the holder has a pair of pulleys supported by the holder relative to their shafts and around which the belt is wound, the pulleys are united with supporting shafts consisting of locking members, guide grooves extending from edges to the inside are formed at one ends of the holder, the supporting shaft for one pulley is set so as to be inserted in the guide grooves, and supporting holes are formed at the other ends of the holder so that the supporting shaft for the other pulley can be fitted into the holes.

According to the invention of claim 5, the guide grooves are formed so as to extend from the edges to the inside at one ends of the holder, the supporting shaft of one pulley is set so that it can be inserted into the guide grooves, and the supporting holes are formed at the other ends of the holder to fit the supporting shaft of the other pulley into the holes. Therefore, the supporting shaft is first fixed to both of the pulleys. Next, the belt with dust removing blades is wound around both the pulleys and one supporting shaft for one pulley is inserted into the guide grooves of the holder and the supporting shaft for the other pulley is fitted into the supporting holes of the holder. Thus, since the supporting shafts and pulleys can be united respectively before winding the belt around both the pulleys and attaching them to the holder, the supporting shafts, pulley and the belt can be attached to or detached from the holder as a single unit. Accordingly, the dust removing head consisting of the moving object and the holder can be easily assembled or disassembled.

The invention of claim 6 provides an apparatus for removing dust from a printing plate of a printing press comprising a guide member supported by a machine mount, being installed in parallel with a plate cylinder axis along a circumferential surface of the plate cylinder; a slider for movement along the guide member; a holder supported by the slider; a moving member supported by the holder, the moving member having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during other times; wherein the holder has a pair of pulleys supported by the holder relative to their shafts and around which the belt is wound, and guide members provided near the pulleys, respectively, for guiding the belt into each diametrical inside of the pulleys.

According to the invention of claim 6, the belt on which the dust removing blades are arranged is wound around the pulleys and guide members and the belt is guided by the guide members into each diametrical inside of the above pulleys, therefore, the dust removing blades can be accommodated in the holder. Accordingly, for the dust removing blades protruding at the both sides of the belt oppositely arranged, a dimension between the tips of the blades becomes smaller. As a result, the thickness of the dust removing head consisting of the moving object and the holder can be reduced and the printing-plate dust removing apparatus can be easily installed in a narrow gap between rollers including the plate cylinder.

The invention of claim 7 provides an apparatus for removing dust from a printing plate of a printing press according to claim 6, wherein the belt is a timing belt and the pair of pulleys is a pair of timing pulleys, and comprising an anti-biting member disposed between the pair of timing pulleys and being supported by the holder, for preventing the timing belt guided by the guide members and the other timing belt passing over the timing belt from biting each other.

According to the invention of claim 7, the holder includes the anti-biting member for preventing the timing belt guided by the guide members and the timing belt passing over the above timing belt from biting each other, and this makes it possible to perform an operation of the timing belt smoothly.

The invention of claim 8 provides an apparatus for removing dust from a printing plate of a printing press comprising a rail frame provided with a pair of guide rails supported by a machine mount, and being installed in parallel with a plate cylinder axis along a circumferential surface of the plate cylinder; a slider for movement along the guide rails; a holder supported by the slider; a moving member supported by the holder and having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during the other time; wherein the guide rails are formed inside the guide frame.

According to the invention of claim 8, the guide rails do not protrude outside since the guide rails are formed inside the guide frame, therefore, the guide rails is not easily stained with ink and slider can be shifted smoothly.

The invention of claim 9 provides an apparatus for removing dust from a printing plate of a printing press according to claim 8 further comprising a first shielding plate disposed on the machine mount so as to be opposite to the guide rails and to extend toward the plate cylinder, and a second shielding plate disposed on the rail frame so as to extend obliquely toward the first shielding plate which can be lifted up by the holder.

According to the invention of claim 9, the guide mils for guiding the slider are formed inside the guide frame, the second shielding plate is placed on the rail frame so as to extend obliquely in the lower direction relative to the guide rails, and the first shielding plate is then placed on the machine mount supporting the rail frame so as to be opposite to the above guide rails, therefore, the above guide rails are covered with the first and second shielding plates, and this prevents the guide rails from getting stained with ink. Accordingly, the slider can be shifted smoothly.

The invention of claim 10 provides a system for removing dust from a printing plate of a printing press, comprising a printing-plate dust removing apparatus which has a guide member supported by a machine mount and being installed in parallel with a plate cylinder axis along a circumferential surface of the plate cylinder; a slider for movement along the guide member; a moving device for moving the slider; a holder supported by the slider; a moving member supported by the holder and having a plurality of dust removing blades arranged with predetermined pitches; and a driving gear for shifting the moving member intermittently between a predetermined standby position where none of the dust removing blades are in contact with the printing plate of the plate cylinder and a position where one of the dust removing blades is in contact with the printing plate of the plate cylinder; the system further comprising a detecting means provided in the driving gear for detecting that the corresponding dust removing blade is located at the predetermined standby position where the blade is isolated from the plate cylinder and to output the detected signal, and a controller for controlling the driving gear so that the moving device transmits a signal to the driving gear so as to shift the above dust removing blade to a next position only when the detected signal from the detecting means is inputted to the controller.

According to the invention of claim 10, the detecting means provided in the driving gear detects that the corresponding dust removing blade is located at the predetermined standby position which is isolated from the plate cylinder, and the controller outputs the signal to the driving gear so that the above dust removing blade is shifted to a next position only when the detected signal for informing that the above blade is located at the predetermined standby position is input from the detecting means to the controller. Accordingly, when the above dust removing blade is not located at the standby position, the controller stops the shift of the dust removing blade.

In the case the dust removing blade is not located at the predetermined standby position, the dust removing blade will not come to a correct dust scraping position even if the blade is shifted by the moving object so as to locate at a working position, and it makes reliability on dust scraping reduce. As shown in the invention, however, if the shift of the dust removing blade is stopped when the dust removing blade is not located at the predetermined standby position, the dust removing operation can be always performed at an accurate working position when the dust removing apparatus is operated. While the shift of the dust removing blade is stopped, it is possible to induce an operator to correct the position of the dust removing blade at the predetermined standby position, thus improving the reliability on dust scraping.

The invention of claim 11 provides a system for removing dust from a printing plate of a printing press comprising a printing-plate dust removing apparatus which has a guide member supported by a machine mount, being installed in parallel with a plate cylinder axis along a circumferential surface of the plate cylinder; a slider for movement along the guide member; a moving device for moving the slider; a holder supported by the slider; a moving member supported by the holder and having a plurality of dust removing blades arranged with predetermined pitches; and a driving gear for shifting the moving member intermittently between a predetermined standby position where any of the dust removing blades is not in contact with the printing plate of the plate cylinder and a position where one of the dust removing blades is in contact with the printing plate of the plate cylinder; the system further comprising a detecting means provided in the driving gear for detecting that the corresponding dust removing blade is located at the predetermined standby position where the blade is isolated from the plate cylinder and to output the detected signal, and a controller for controlling the driving gear so that the moving device transmits a signal to the moving device so as to shift the slider only when the detected signal for informing that the above blade is located at the predetermined standby position is inputted from the detecting means to the controller.

According to the invention of claim 11, the detecting means provided in the driving gear detects that the corresponding dust removing blade is located at the predetermined standby position which is isolated from the plate cylinder, and the controller outputs the signal for shifting the slider to the moving device only when the detected signal for informing that the above blade is located at the predetermined standby position is input from the detecting means to the controller. Accordingly, when the above dust removing blade is not located at the standby position, the controller stops the slider. For this reason, the controller can stop the shift of the slider when the dust removing blade is located at a position which is in contact with the printing plate of the plate cylinder, therefore, the printing plate on the plate cylinder can be prevented from getting damaged by the dust removing blade, and this makes it possible to improve its reliability.

The invention of claim 12 provides a system for removing dust from a printing plate of a printing press comprising a printing-plate dust removing apparatus which has a guide member supported by a machine mount installed in parallel with a plate cylinder axis along a circumferential surface of the plate cylinder; a slider for movement along the guide member; a moving device for moving the slider; a holder supported by the slider; a moving member supported by the holder and having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during other times; the system further comprising a detecting sensor fixed on the machine mount for detecting that the slider comes to a predetermined position, and a controller for presuming a slider position to set the slider to a target position based on the presumed position, wherein the controller receives a detected signal from the detecting sensor and compares an actual position of the slider determined from the detected signal with the presumed position of the slider that is now in recognition so that both the positions are processed to be able to coincide them with each other.

According to the invention of claim 12, the detecting sensor is installed on the machine mount for detecting an actual position of the slider, the controller presumes a position of the slider and compares the presumed position of the slider with the actual position detected by the above sensor so that both the positions are processed to be able to coincide them with each other, and this makes it possible to regard the presumed position as not having any error relative to the actual position. Accordingly, the slider position can be accurately presumed and the slider can be set to the target position securely.

The invention of claim 13 provides a system for removing dust from a printing plate of a printing press according to claim 12, wherein the detecting sensor is provided at an end of the guide member not opposite to the plate cylinder, and the controller is programmed to memorize that a stop position of the slider is within the whole area except the both ends of the guide member so that the slider is stopped at the above stop position when the dust removing operation is not being performed.

According to the invention of claim 13, the controller stops the slider at the stop position which is memorized as a position within the whole area except the both ends of the guide member, therefore, the slider can stop at a position except the both ends of the guide member where ink is intensively scattered. Accordingly, when the operation of the slider is stopped, the slider and the dust removing head are prevented from getting stained with ink excessively, and the shift of the slider and the dust scraping operation can be properly performed.

The invention of claim 14 provides a system for removing dust from a printing plate of a printing press comprising a printing-plate dust removing apparatus which has a guide member supported by a machine mount and installed in parallel with a plate cylinder axis along a circumferential surface of the plate cylinder; a slider for movement along the guide member; a moving member supported by the slider; a moving member supported by the holder and having a plurality of dust removing blades arranged with predetermined pitches; and a driving gear for shifting the moving member intermittently so that one of the dust removing blades is in contact with the printing plate of the plate cylinder during dust removing operation and the dust removing blade is isolated from the plate cylinder during the other times; the system further comprising a counter for counting the number of times the moving member has performed the dust removing operation, and a display device for displaying the value counted by the counter.

According to the invention of claim 14, the counter counts the number of times the moving object with the dust removing blades has performed the dust removing operation and the display shows the counted value, therefore, this makes it possible to confirm of whether all the dust removing blades on the moving object are used predetermined times for the dust removing operation. Accordingly, the dust removing blades can be prevented from being used over the predetermined times and reliability on dust scraping by use with the dust removing blades can be improved.

The invention of claim 15 provides an apparatus for removing dust from a printing plate of a printing press comprising a guide member supported by a machine mount, being installed in parallel with a plate cylinder axis along a circumferential surface of the plate cylinder; a slider for movement along the guide member; a holder supported by the slider; a moving member supported by the holder and having a plurality of dust removing blades arranged with predetermined pitches; and adriving gear for shifting the moving member intermittently so that one of the dust removing blades is in contact with the printing plate of the plate cylinder during dust removing operation and the dust removing blade is isolated from the plate cylinder during the other times; and wherein the moving member is a timing belt having teeth only on the back side of the timing belt, and the dust removing blades are provided on the front side of the timing belt so as to protrude from positions where the tops of the teeth are disposed on the back side.

According to the invention of claim 15, the dust removing blades are provided on the surface of the timing belt constituting the moving object so as to protrude from the positions corresponding to the tops of the teeth formed on the back side of the belt, so that the dust removing blades can be united with the timing belt and the timing belt can be wound around a pair of pulleys supported by the holder with a smaller radius of curvature. As a result, this achieves a thinner dust removing head.

BEST MODE FOR CARRYING OUT THE INVENTION

A. A first embodiment of an apparatus for removing dust from a printing plate of a printing press as shown in FIGS. 1 to 6 (which corresponds to claim 1 and 2).

Figure 1A:
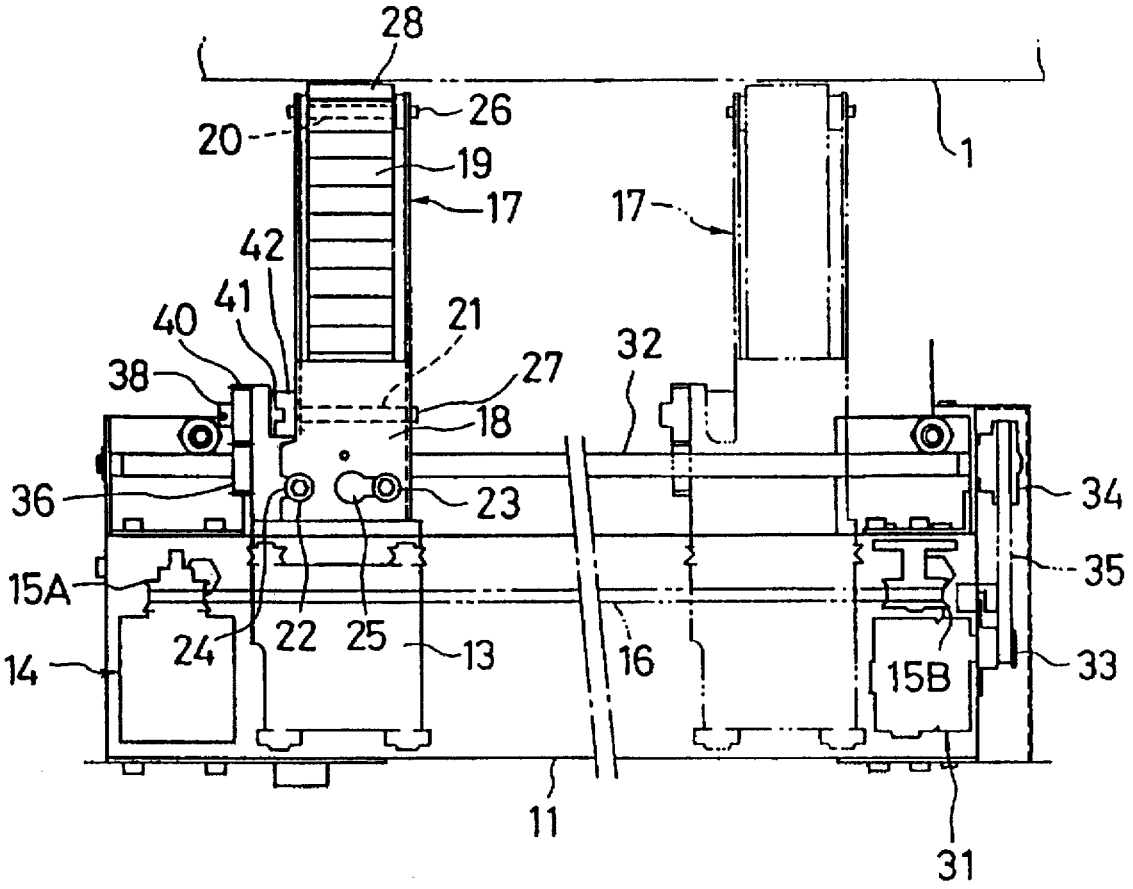
FIG. 1 shows an apparatus for removing dust from a printing-plate of printing press according to a first embodiment of the invention; (a) is a plan view and (b) is a side view.
Figure 1B:
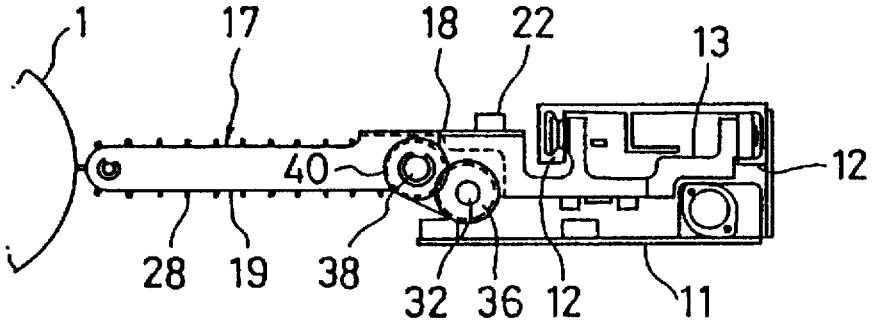

In FIG. 1, a guide rail 12 is formed on a machine mount 11 so as to be in parallel with an axial direction of a plate cylinder 1 over the whole length thereof and a slider 13 is supported by the guide rail 12. An end of a wire 16 which is moved by a moving device 14 including a stepping motor is fixed to the slider 13. The moving device 14 is fixed inside the machine mount 11 and the wire 16 is wound around a pulley 15A fixed to the output shaft of the moving device 14 and a pulley 15B is supported in the other side of the machine mount 11 relative to its shaft. Then, when a dust position has been specified by a dust removing position specifying button or the like, not shown, the moving device 14 shifts the slider 13 along the guide rail 12 to locate the slider 13 at the specified position.

The slider 13 is provided with a dust removing head 17 having a holder 18 removably attached to the slider 13 and a moving member 19 supported by the holder 18. The moving member 19 is in the form of a timing belt and it is wound around two pulleys 20 and 21 which are supported by the holder 18 and of which axes are in parallel with the axial direction of the plate cylinder 1.

The holder 18 is provided with a fitting slit 24 and a fitting hole 25 for inserting two fitting bolts 22 and 23 attached to the slider 13. The holder 18 is then fixed to the slider 13 with the bolts 22 and 23 by moving the holder 18 sideways in the condition that the large diameter hole portion of the fitting hole 25 is set under the head of the fitting bolt 23 so that the fitting slit 24 and the small diameter hole portion of the fitting hole 25 are respectively located under the heads of the fitting bolts 22 and 23.

Timing pulleys 20 and 21 are provided apart from each other in the diametrical direction of the plate cylinder 1 and one timing pulley 20 located in the side of the plate cylinder 1 is rotatably supported by a supporting shaft 26 attached to the holder 18. The other pulley 21 is then fixed to a driven shaft 27 rotatably supported by the holder 18.

The moving member 19 has a plurality of dust removing blades 28 provided thereon with equal pitches and it is wound around both the pulleys 20 and 21 in the condition that the blades 28 face outside. When both the pulleys 20 and 21 are driven so as to rotate intermittently, the moving member 19 is then shifted intermittently.

A driving gear 31 including a stepping motor is fixed on the machine mount 11 and a first driving shaft 32 having a four-cornered cross section, being in parallel with the axial direction along the whole length of the plate cylinder 1, is rotatably supported by the machine mount 11. A power transmission belt 35 is then wound around a pulley 33 fixed to an output shaft of the driving gear 31 and a pulley 34 of the first driving shaft 32, therefore, the first driving shaft 32 can be rotated intermittently by the driving gear 31.

In the slider 13, a gear 36 is rotatably supported by a retaining ring 37 so as to retain the gear 36 and the above first driving shaft 32 having the four-cornered cross section penetrates a four-cornered hole provided along the central axis of the gear 36. Thus, the gear 36 is engaged with the first driving shaft 32 in the rotational direction. Also, a second driving shaft 38 is rotatably supported by the slider 13 and a gear 40 is then fixed by a pin 39A and a retaining ring 39B so as to engage the gear 36 and the gear 40 with each other at any time.

Accordingly, when the slider 13 has been shifted along the guide rail 12 by the operation of the moving device 14 discussed above, the gear 36 supported by the slider 13 is moved in the axial direction of the first driving shaft 32 while keeping engagement with the first driving shaft 32. Then, when the first driving shaft 32 is intermittently rotated by the operation of the driving gear 31 discussed above, the intermittently rotational power is transmitted to the second driving shaft 38 through the gears 36 and 40.

On the other hand, the second driving shaft 38 is located on the same axis as the driven shaft 27 for the moving member 19, in which a driving-side coupling member 41 is provided in the second driving shaft 38, a driven-side coupling member 42 is provided in the driven shaft 27, and the first interlocking claws 41A of the driving-side coupling member 41 are engaged with the second interlocking claws 42A of the coupling member 42. Thus, the intermittently rotational power transmitted to the above second driving shaft 38 is transmitted to the driven shaft 27, then, to the moving member 19 through the timing pulley 21 fixed to the driven shaft 27 so that the moving member 19 is intermittently shifted.

Figure 5A:
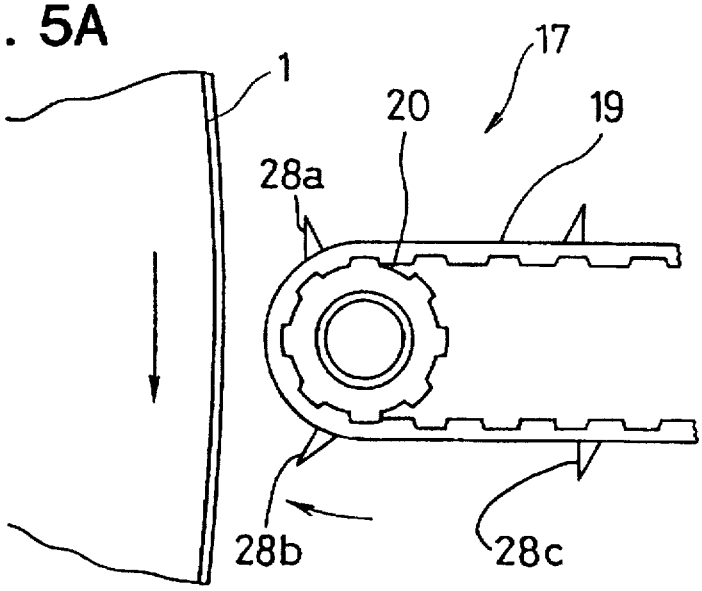
FIG. 5 is a schematic diagram showing positions of a moving member of FIG. 1; (a) shows a position in a standby state and (b) shows a position in a working state.
Figure 5B:
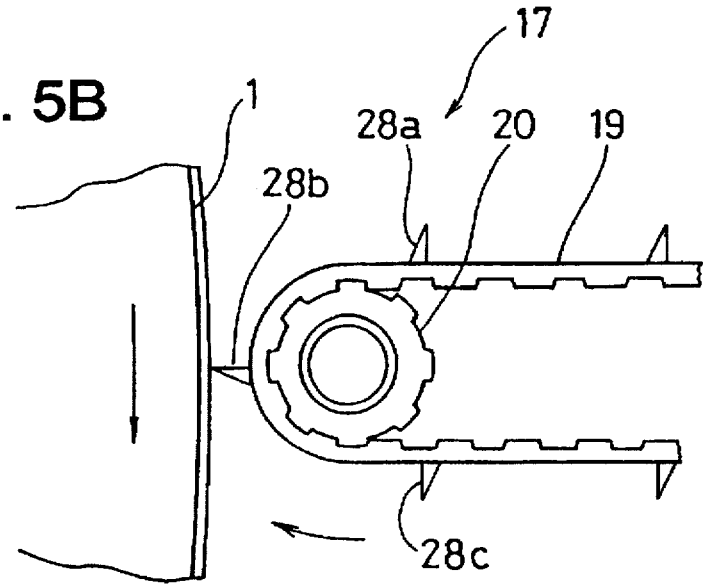

At this time, the driving gear 31 locates the moving member 19 at a working position where one of the dust removing blades 28 is in contact with the printing plate of the plate cylinder 1 during dust removing (FIG. 5(*b*)) or at a standby position where the dust removing blade is isolated from the plate cylinder 1 during the other time (FIG. 5(*a*)).

The interlocking claws 41A and 42A of both the coupling members 41 and 42 are also specified as follows: the setting position of the interlocking claws 41A and 42A is set so that the driven-side coupling member 42 can be engaged with the driving-side coupling member 41 only at a position where the moving member 19 is located at the standby position under the condition that the second driving shaft 38 stops its intermittent rotation.

In this embodiment, the setting of the dust removing blades 28 on the moving member 19 and the specifying on the interlocking claws 41A and 42A of both the coupling members 41 and 42 are concretely carried out as follows:

The moving member 19 is provided with the dust removing blades 28 which are spaced by 120° at equal pitches around the timing pulleys 20 and 21, both being opposite to the plate cylinder 1, and the driving gear 31 locates the moving member 19 alternately at the working position and the standby position by rotating the timing pulleys 20 and 21 intermittently by 60° at a step (FIG. 1(*b*)). Therefore, when the driving gear 31 stops the second driving shaft 38, i.e., when it locates the moving member 19 at the standby position, the interlocking claws 41A and 42A of both the coupling members 41 and 42 are stopped at a fixed stop position at any time.

Figure 2:
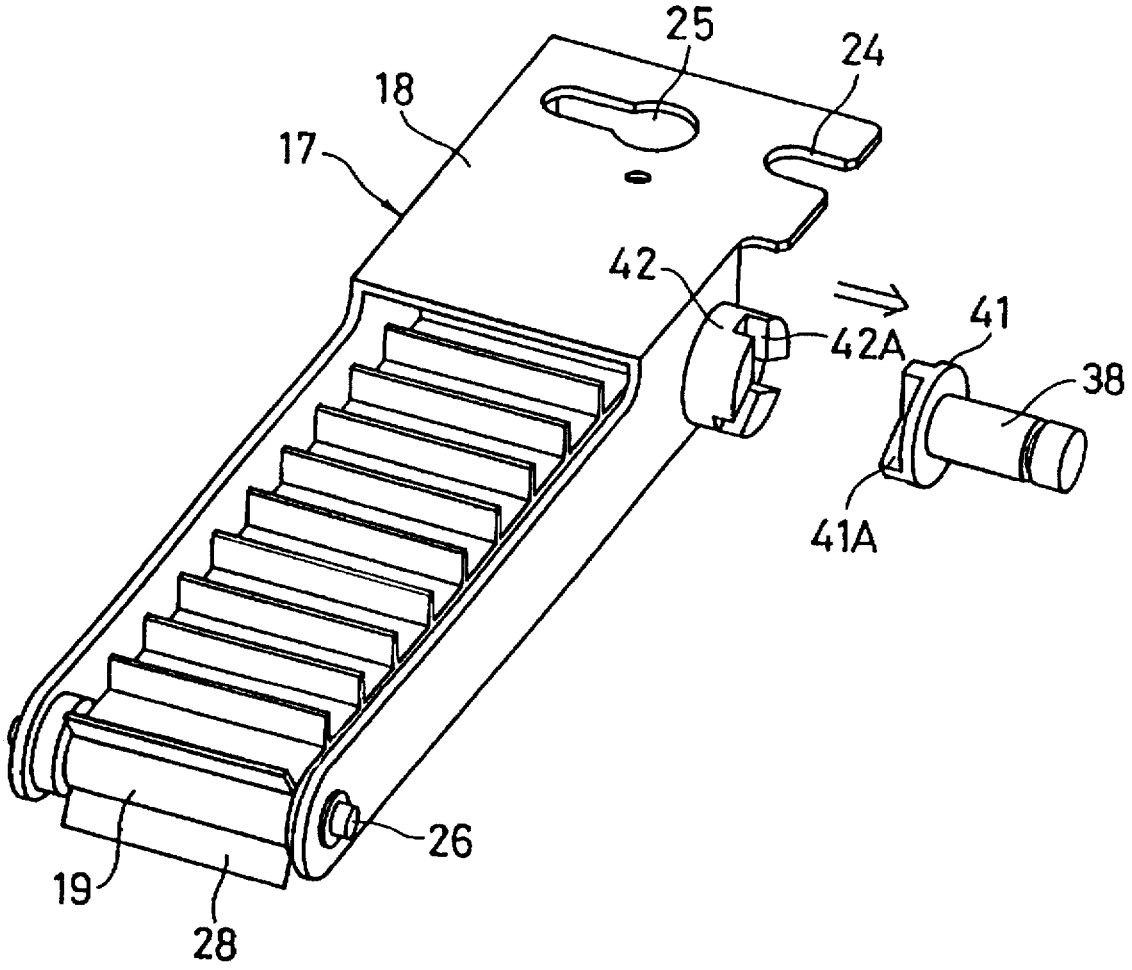
FIG. 2 is a perspective view of FIG. 1.
Figure 3:
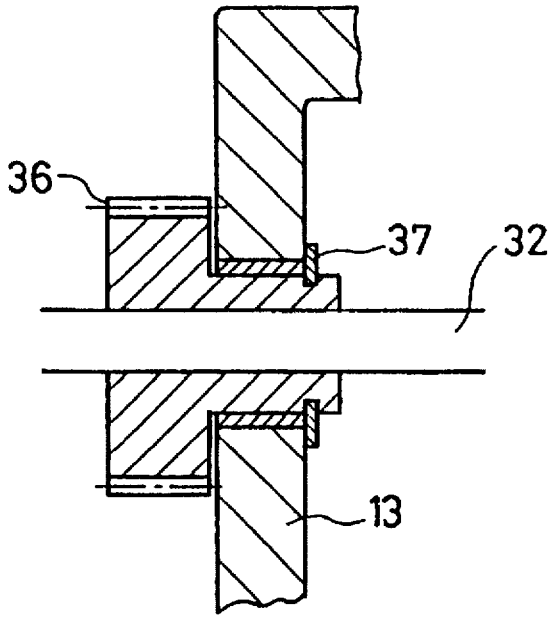
FIG. 3 is a cross-sectional view showing a state of a power transmission shaft inserted into a slider of FIG. 1.
Figure 4:
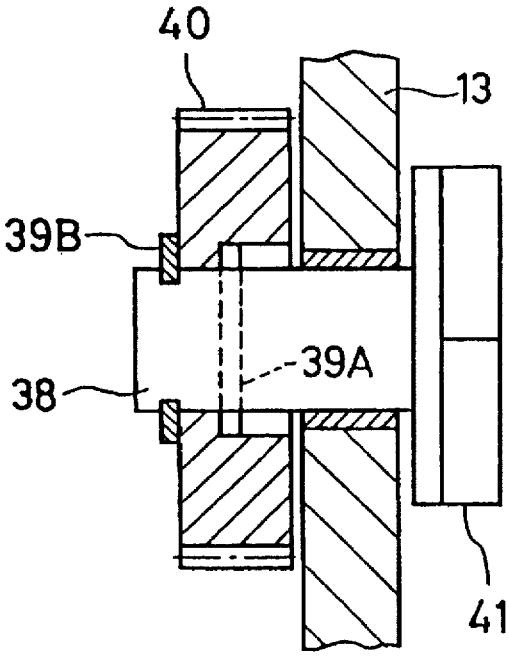
FIG. 4 is a cross-sectional view showing a state of a driving shaft supported by the slider of FIG. 1.
Figure 6:
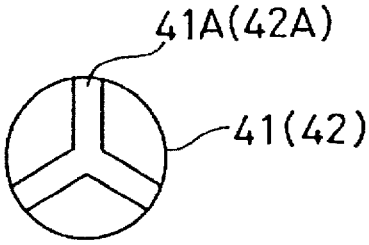
FIG. 6 is a front view of a coupling member shown in FIG. 2.

To accomplish this, the interlocking claw 41A of the driving-side coupling member 41 is set so that three convex portions are arranged apart from each other by 120° thereon to always direct one of the convex portions in the vertical direction when the second driving shaft 38 is stopped, as shown in FIG. 6. On the other hand, the interlocking claw 42A of the driven-side coupling member 42 is set so that three concave portions are arranged apart from each other by 120° thereon and the phase between the interlocking claw 42A and the dust removing blade 28 on the moving member 19 is adjusted so as to locate the moving member 19 at the standby position when one of the concave portions is directed upward in the vertical direction as shown in FIG. 6 (FIG. 2). By specifying the setting position of the interlocking claws 41A and 42A of both the coupling members 41 and 42 discussed above, the driven-side coupling member 42 can be engaged with the driving-side coupling member 41 only at the interlocking position where the moving member 19 is located at the standby position under the condition that the second driving shaft 38 stops its intermittent rotation.

The dust removing operation of the embodiment will be described below.

(1) If an operator has found a hickey area on print, he or she specifies the hickey position to the dust removing apparatus by an unillustrated dust removing position specifying button or the like. The moving device 14 then shifts the slider 13 so as to be located at the specified hickey position after receiving the signal input by the operator. During this shift, the moving member 19 is located at a standby position where a distance between the adjacent dust removing blades 28*a* and 28*b* is opposite to the printing plate of the plate cylinder 1, as shown in FIG. 5(*a*).

(2) When the slider 13 has been located at the specified position, the driving gear 31 rotates the moving member 19 at 60° so that the dust removing blade 28*b* is located at a working position where the blade 28*b* is in contact with the printing plate of the plate cylinder 1, as shown in FIG. 5(*b*). Then, the dust removing blade 28*b* is pressed on the printing plate of the plate cylinder 1. Dust adhered to the printing plate is removed by the dust removing blade 28*b* since the plate cylinder 1 rotates itself.

(3) After a few minutes from the condition above (2), the driving gear 31 rotates the moving member 19 at 60° again and sets it in the standby condition. This re-driving operation releases the dust removing blade 28*b*, to which dust is adhered, upward from the working position and locates a new dust removing blade 28*c* at the standby position.

Next, an exchange operation of the moving member in the embodiment will be described.

(1) In the dust removing head 17, when all the dust removing blades 28 provided on the moving member 19 become ineffective to perform the dust removing operation discussed above, the holder 18 of the current dust removing head 17 is detached from the slider 13. At this time, the driven-side coupling member 42 located in the side of the holder 18 is released from the driving-side coupling member 41 located in the side of the slider 13.

(2) Then, another dust removing head 17 provided with a new moving object 19 is prepared and a new holder 18 of this dust removing head 17 is attached to the slider 13. At this time, one of new dust removing blades 28 of the new moving member 19 is automatically set to a predetermined standby position discussed above only when the driven-side coupling member 42 located in the side of the holder 18 is connected with the driving-side coupling member 41 located in the side of the slider 13.

Next, the effects of the embodiment will be described below.

(1) The position of the moving member 19 is always managed by the driving gear 31. In other words, the moving member 19 is always located alternately at the working position and the standby position by the driving gear 31. Therefore, a detector need not be attached to the holder 18 etc. of the moving member 19 to detect the current position of the dust removing blades 28 on the moving member 19, so that a compact configuration of the apparatus can be achieved.

(2) When the second driving shaft 38 stops its intermittent rotation, the driving-side coupling member 41 is stopped at a position where the moving member 19 is set to the standby position according to (1). The driven-side coupling member 42 located in the side of the new moving member 19 is then engaged with the above driving-side coupling member 41 only at the interlocking position where the moving member 19 is located at the standby position by specifying the setting position of the interlocking claws 41A and 42A of the driving-side coupling member 41 and the driven-side coupling member 42 as discussed above. Accordingly, when the moving member 19 is exchanged together with the holder 18, the dust removing blade 28 of the above moving member 19 can be automatically set to the position (standby position) where the blade 28 is not opposite the plate cylinder 1, without fail, only by engaging the driven-side coupling member 42 with the driving-side coupling member 41.

In the above embodiment, the moving member has the form of the timing belt which is wound around a pair of timing pulleys 20 and 21. However, it may also be formed of a normal belt, a chain, or a metal belt, respectively provided with dust removing blades around its outer periphery with predetermined pitches, instead of the timing belt.

Also, since the driving shaft 38 supported by the slider 13 and the driven shaft 27 supported by the holder 18 are connected with each other through the coupling members 41 and 42, the driving shaft 38 and the driven shaft 27 can be easily separated when the holder 18 is detached from the slider 13. On the other hand, when the holder 18 is attached to the slider 13, the driving shaft 38 and the driven shaft 27 can be easily connected with each other by using the coupling members 41 and 42. Accordingly, the operation of detaching or attaching the holder 18 from or to the slider 13 is easily improved.

B. A second embodiment of an apparatus for removing dust from a printing plate of a printing press (FIGS. 7 to 13: which corresponds to claims 3, 5 and 6).

Figure 7:
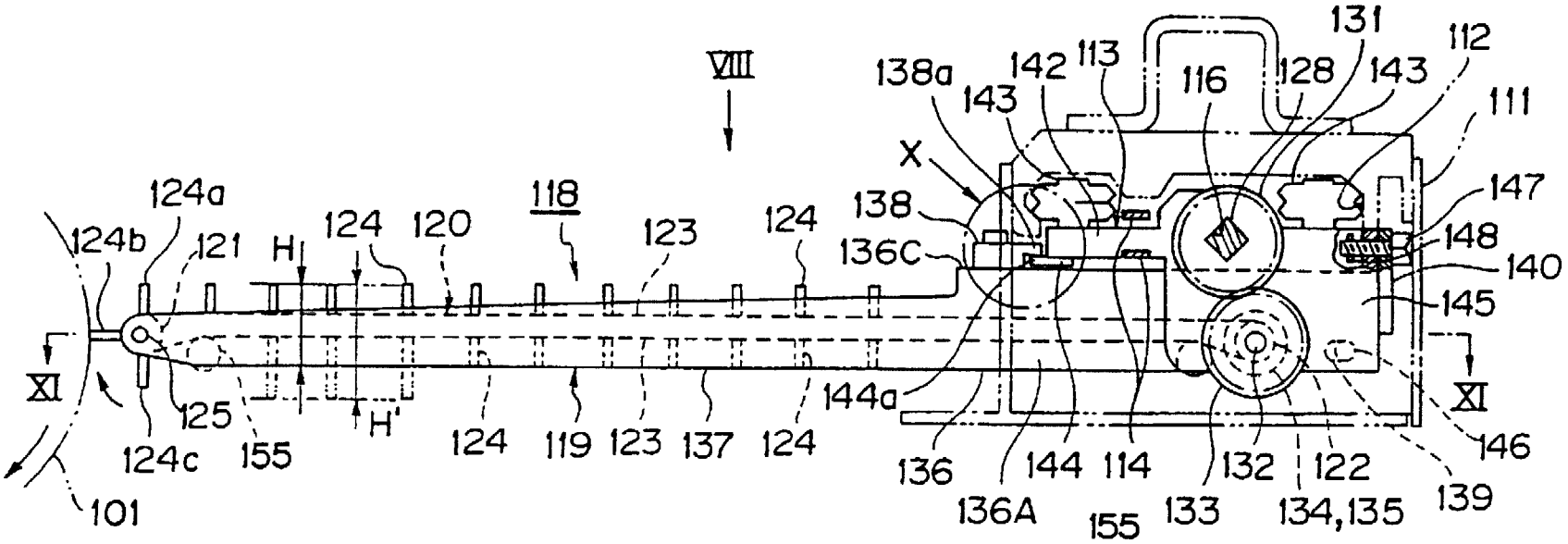
FIG. 7 is a side view of an apparatus for removing dust from a printing-plate of printing press according to a second embodiment of the invention.
Figure 8:
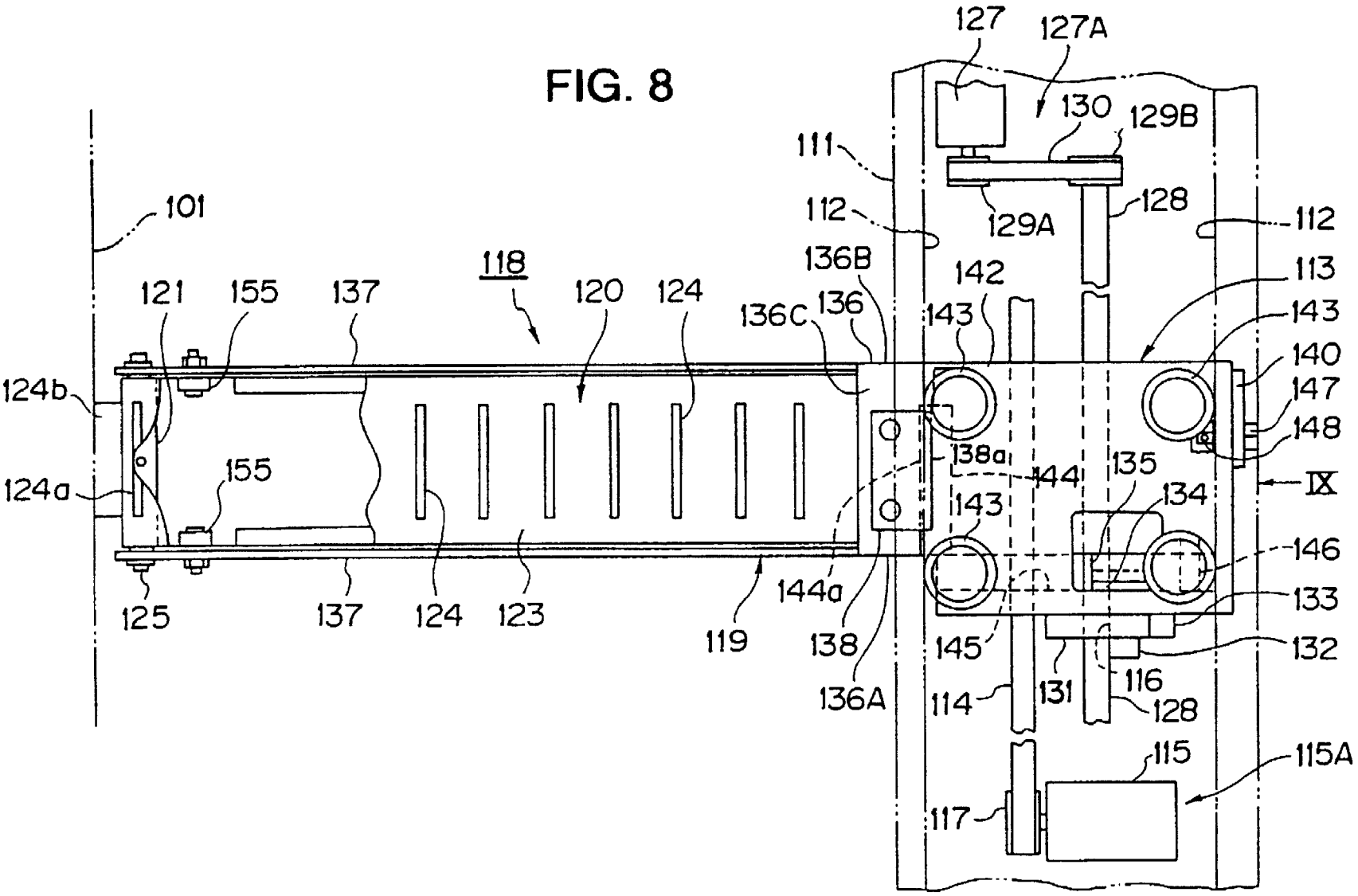
FIG. 8 shows a section that it is seen from arrow VIII of FIG. 7.

As shown in FIGS. 7 and 8, a guide rail 112 is formed on a frame 111 as a machine mount so as to be in parallel with an axial direction of a plate cylinder 101 of a printing press over a whole length thereof. A slider 113 is then supported by the guide rail 112 and a slider belt 114 is fixed to the slider 113. The slider belt 114 is shifted by a moving device 115A including a stepping motor 115 which is fixed inside the frame 111.

The slider belt 114 is wound around a pulley 117 fixed to the output shaft of the stepping motor 115 and another pulley (not shown) placed in the other side of the frame 111. Then, when a dust position on the printing plate of the plate cylinder 101 has been specified by an operation of a dust removing position specifying button, not shown, the stepping motor 115 shifts the slider 113 along the guide rail 112 so that the slider 113 is located at the specified dust position.

Figure 12:
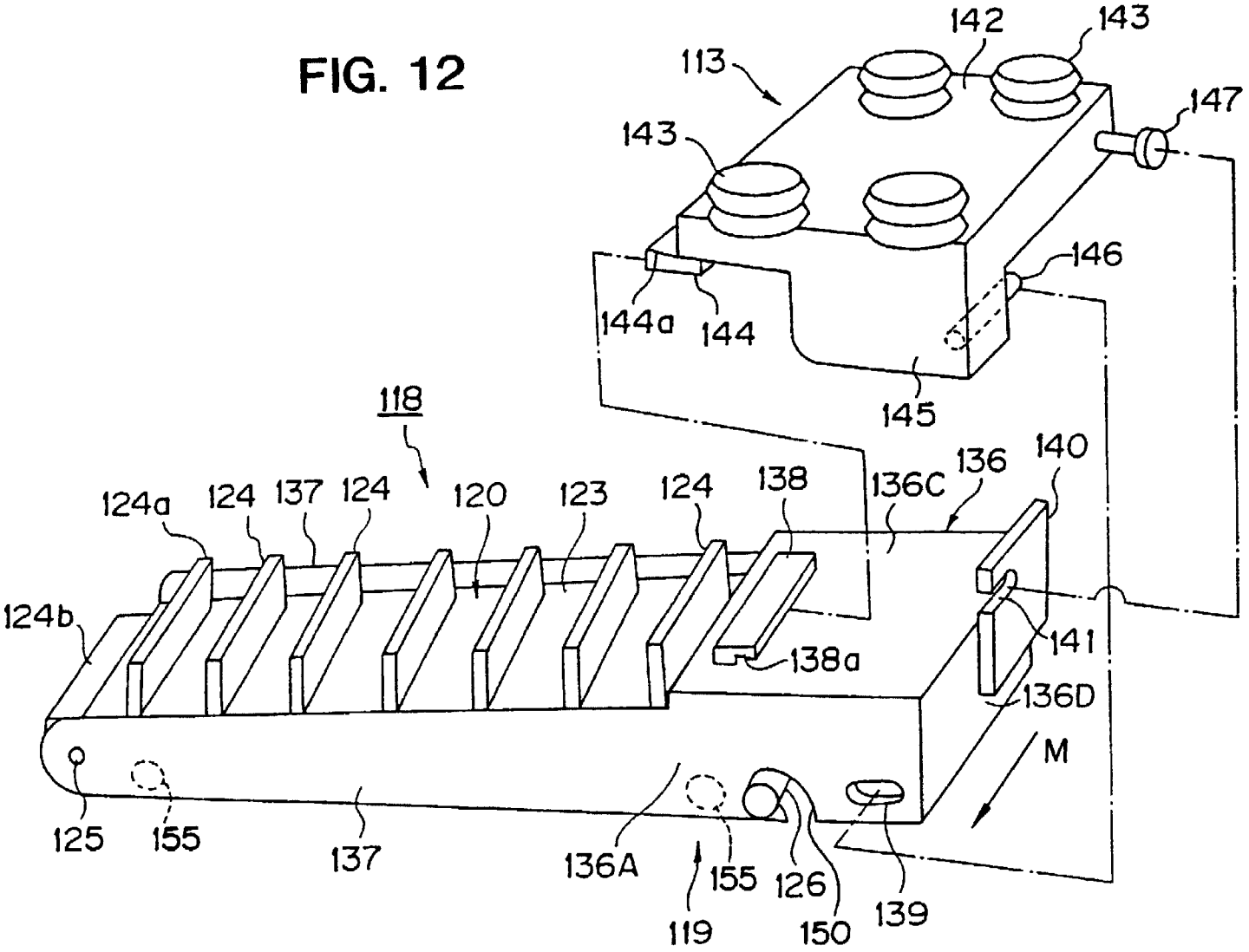
FIG. 12 is an exploded perspective view of a dust removing head and the slider of FIG. 7.

As also shown in FIG. 12, a dust removing head 118 is installed on the slider 113 and is formed of a holder 119 capable of attaching to or detaching from the slider 113 and a moving member 120 supported by the holder 119. The moving member 120 is constituted of a dust removing belt 123 which is wound around two timing pulleys 121 and 122 supported by the holder 119 and a plurality of dust removing blades 124 provided outside the dust removing belt 123 with equal pitches.

Figure 11:
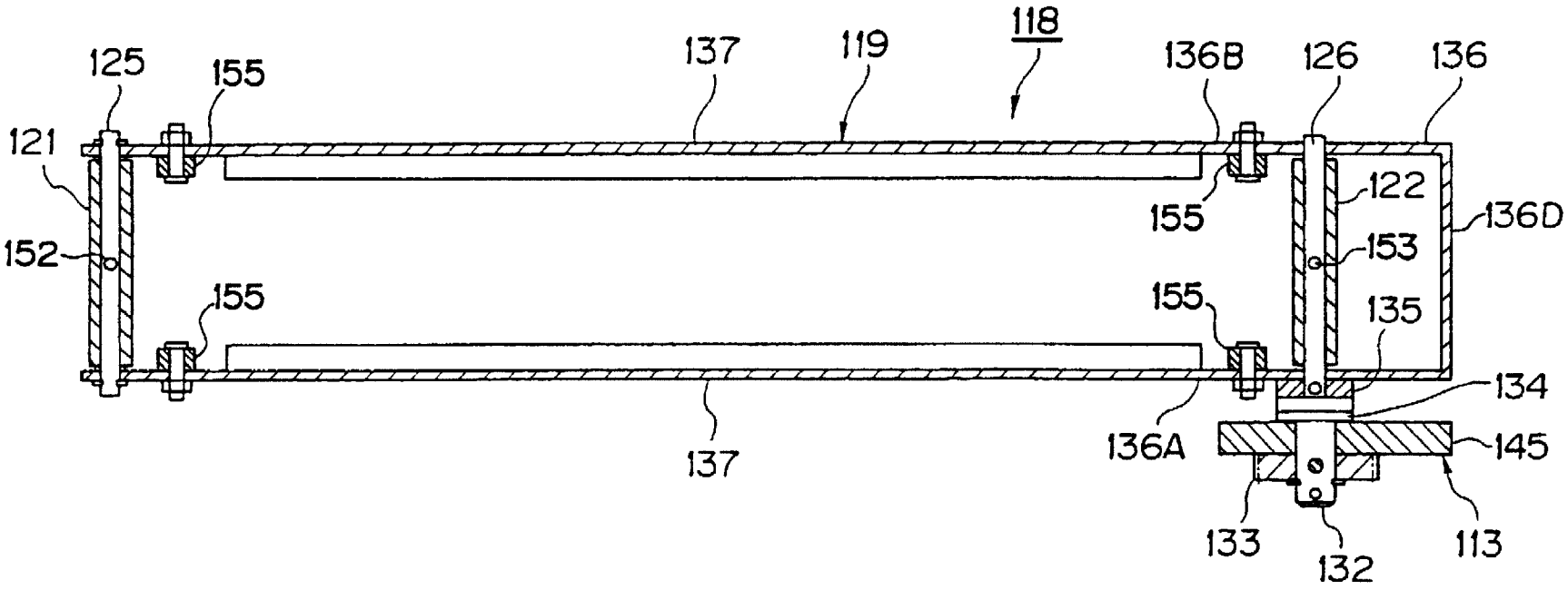
FIG. 11 is a cross-sectional view taken along line XI—XI of FIG. 7.

The timing pulleys 121 and 122, as also shown in FIG. 11, are supported by the holder 119 so that their central axes are in parallel with the axial direction of the plate cylinder 101 and they are spaced apart from each other in the diametrical direction of the plate cylinder 101. One timing pulley 121 located in the side of the plate cylinder 101 is rotatably supported by the holder 119 through a supporting shaft 125. The other pulley 122 is then rotatably supported by the holder 119 through a driven shaft 126. The dust removing belt 123 is intermittently shifted by the intermittent rotation of the driven shaft 126. The intermittent rotation of the driven shaft 126 is caused by a driving gear 127A (FIG. 8).

The driving gear 127A is provided with a stepping motor 127 and it is fixed to the frame 111. Also, a first driving shaft 128 is rotatably supported by the frame 111 so as to be in parallel with the axial direction of the length of the plate cylinder 101. Then, a power transmission belt 130 is wound between a pulley 129A fixed to the driving shaft of the stepping motor 127 and another pulley 129B fixed at the end of the first driving shaft 128, and this makes it possible to rotate the first driving shaft 128 intermittently by the driving force of the stepping motor 127 through the pulleys 129A, 129B and the power transmission belt 130.

As shown in FIG. 7, the first driving shaft 128 has a four-cornered cross section and it is engaged with a gear 131 by penetrating a four-cornered hole 116 provided in the gear 131. The gear 131 is rotatably supported by the slider 113 and the four-cornered hole 116 is provided along the central axis of the gear 131. Also, a second driving shaft 132 is rotatably supported by the slider 113 and a gear 133 is fixed to the second driving shaft 132. These gears 131 and 133 are always engaged with each other. Then, as shown in FIG. 11, the second driving shaft 132 is connected with the driven shaft 126 through coupling members 134 and 135.

Accordingly, when the slider 113 has been shifted along the guide rail 112 by the driving force of the stepping motor 115 in the above moving device 115A (FIG. 8), the gear 131 of the slider 113 is shifted in the axial direction of the first driving shaft 128 in the condition that the four-cornered hole 116 is engaged with the first driving shaft 128. Also, when the first driving shaft 128 has been intermittently rotated through the power transmission belt 130 and the like by the driving force of the stepping motor 127 in the driving gear 127A, this intermittently rotational power is transmitted to the second driving shaft 132 through the gears 131 and 133 and it is transmitted to the driven shaft 126 through the coupling members 134 and 135. The intermittent rotation of the driven shaft 126 is then transmitted to the dust removing belt 123 through the timing pulley 122 so as to shift the dust removing blades 124 intermittently.

The driving gear 127A also shifts the moving member 120 so that one of the dust removing blades 124 is located at a working position where the corresponding dust removing blade is opposite to the plate cylinder 101 during dust removing operation or at a standby position where a portion of the belt 123 not arranging any of the dust removing blades 124 is opposite to the plate cylinder 101.

That is, when a dust removing specifying button, not shown, is operated after an operator has found a hickey area on prints, the hickey position is specified to the dust removing apparatus. Then, the slider moving device 115A actuates the stepping motor 115 so that the slider belt 113 is sifted through the slider belt 114 to locate the dust removing head 118 at the specified hickey position after receiving the signal input by the operation. During this shift, the moving member 120 sets a distance between adjacent dust removing blades 124*a* and 124*b* (FIG. 7) to be opposite to the plate cylinder 101 (the standby position).

When the dust removing head 118 has been located at the specified hickey position, the driving gear 127A actuates the stepping motor 127 and rotates the dust removing belt 123 at a predetermined degree so that the dust removing blade 124*b* is opposite to the plate cylinder 101 (the working position). Therefore, the dust removing blade 124*b* is pressed onto the plate cylinder 101. At this time, dust adhered to the printing plate of the plate cylinder 101 is scraped and removed since the plate cylinder 101 rotates.

After a few minutes from the above condition, the driving gear 127A rotates the dust removing belt 123 of the moving member 120 at a predetermined degree again and sets it in the standby position. By driving of the moving member 120, the dust removing blade 124*b* which has already scraped the dust proceeds upward and a new dust removing blade 124*c* is placed at the standby position.

Next, a configuration of connection between the dust removing head 118 and the slider 113 will be described.

As shown in FIGS. 7, 8 and 12, the holder 119 of the dust removing head 118 is formed such that two plate-shaped holder long parts 137 are connected with a channel-section holder basic part 136. The holder long parts 137 are continuously connected with both sides 136A and 136B of the holder basic part 136, respectively. A locking rail 138 as the first wedge member is then fixed on the top surface 136C of the holder basic part 136 and an elliptic hole 139 is formed in the lower side on the side surface 136A. The long side direction of the elliptic hole 139 is formed so as to correspond to the long side direction of the holder long part 137.

Also, a holder plate 140 as a receiving member is fixed by a bolt on the back side 136D of the holder basic part 136. The holder plate 140 protrudes upward from the top surface 136C and an inserting groove 141 is formed in the protruding portion of the holder plate 140 so as to open to the side 136A of the holder basic part 136.

Figure 10:
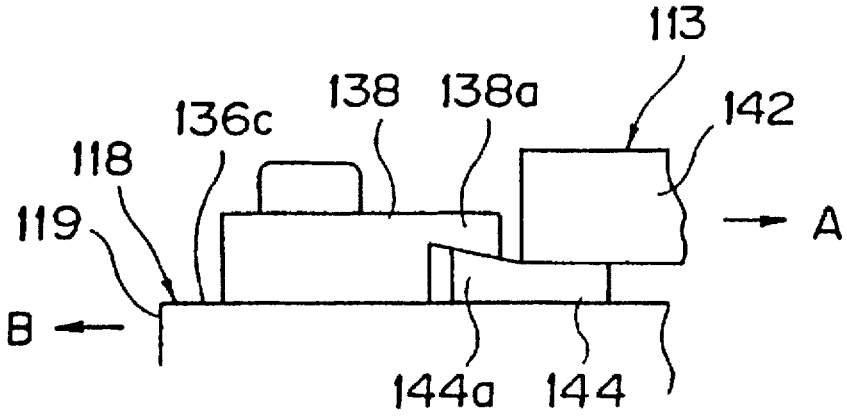
FIG. 10 is an enlarged diagram showing section X of FIG. 7.

On the other hand, the slider 113 has an angle-like cross section and a plurality of rollers 143 are provided on the top portion 142 of the slider 113. These rollers 143 are fitted with the guide rail 112 of the frame 111 so that the slider 113 can be rotated along the guide rail 112. Also, a locking rail 144 as the second wedge member is fixed on the top portion 142 of the slider 113. The locking rail 144 and the above locking rail 138, as shown in FIG. 10, are provided with wedge type portions 144*a* and 138*a*, respectively, and this makes it possible to engage the rails 144 and 138 with each other.

Figure 9:
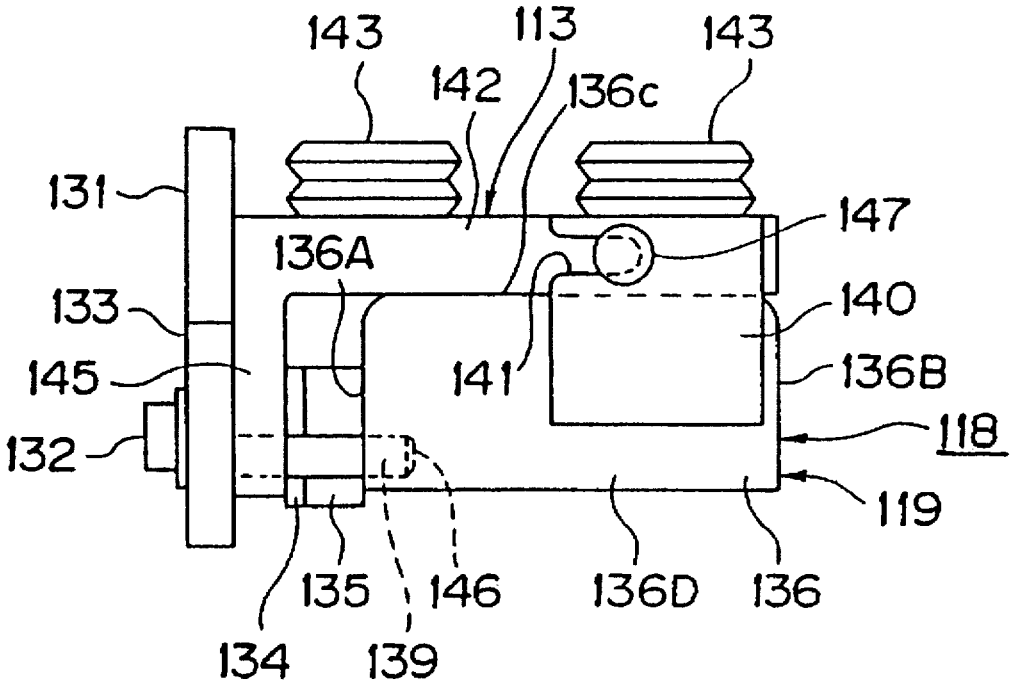
FIG. 9 shows a section that it is seen from arrow IX of FIG. 8.

As shown in FIGS. 9 and 12, a supporting pin 146 is implanted inside the side portion 145 of the slider 113 so that the supporting pin 146 can be inserted into the elliptic hole 139 of the holder 119. Also, a clamping bolt 147 as a clamping member is provided on the back surface of the top portion 142 of the slider 113 by clamping of a screw so that the clamping bolt 147 can be inserted into the inserting groove 141 of the holder plate 140. In addition, a retaining pin 148 is attached to the tip of the clamping bolt 147 to prevent the clamping bolt 147 from falling off (FIGS. 7 and 8).

The connection between the dust removing head 118 and the slider 113 is initiated when the holder 119 of the dust removing head 118 slides in the direction of arrow M (FIG. 12) relative to the slider 113 so that the wedge portion 144*a* of the locking rail 144 is engaged with the wedge type portion 138*a* of the locking rail 138. In this engagement, the supporting pin 146 of the slider 113 is inserted into the elliptic hole 139 of the holder 119 and the clamping bolt 147 of the slider 113 is inserted into the inserting groove 141 of the holder plate 140. Next, as shown in FIG. 7, the clamping bolt 147 is clamped so that the holder plate 140 is held between the head of the clamping bolt 147 and the back surface of the top portion 142 of the slider 113. In addition, when the wedge portion 138*a* is engaged with the wedge portion 144*a*, a clearance is allowed in advance between facing surfaces of the holder plate 140 and the back surface of the top portion 142 of the slider 113. The slider 113 and the holder 119 are relatively shifted in the isolating direction, as shown by arrows A and B in FIG. 10, during clamping of the clamping bolt 147 so that the wedge portion 138*a* of the locking rail 138 is firmly engaged with the wedge portion 144*a* of the locking rail 144. During this slight shift, the supporting pin 146 is moved inside the elliptic hole 139 along the long side direction thereof.

Next, a configuration of the dust removing head 118 will be described.

Figure 13:
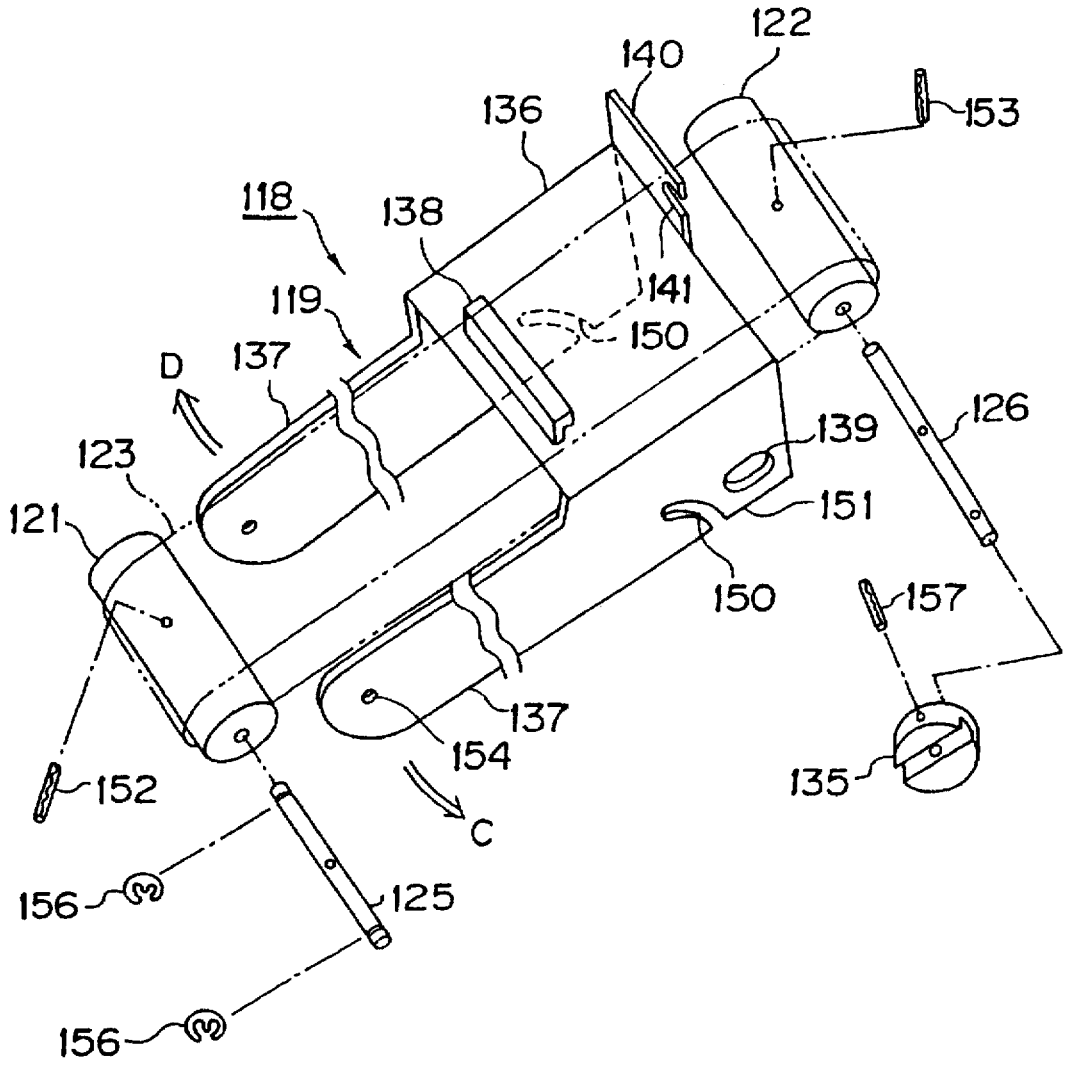
FIG. 13 is an exploded perspective view of the dust removing head of FIG. 7.

In the holder 119 of the dust removing head 118, as shown in FIGS. 12 and 13, guide grooves 150 are formed on both sides 136A and 136B of the holder basic part 136. The guide grooves 150 are provided to extend inside from the bottom edges 151 (in FIGS. 12 and 13) of the both sides 136A and 136B of the holder basic part 136 so that the driven shaft 126 can be inserted into the guide grooves 150. The driven shaft 126, as shown in FIGS. 11 and 13, can be treated as an unit together with the timing pulley 122 by using a locking pin 153 as a locking member. Likewise, the supporting shaft 125 can be also treated as an unit together with the timing pulley 121 by using a locking pin 152.

Furthermore, supporting holes 154 are provided on the holder long parts 137 of the holder 119. The supporting shaft 125 united with the timing pulley 121 is rotatably supported by the supporting holes 154. As shown in FIG. 13, the holder long parts 137 are constituted so that they can be flexible in the direction of arrows C and D relative to the holder basic part 136.

In both the holder long parts 137, as shown in FIGS. 7, 8 and 11, guide rollers 155 as guide members are set near the supporting holes 154. Also, in both the sides 136A and 136B of the holder basic part 136, guide rollers 155 are set near the guide grooves 150. The dust removing belt 123 which is wound around the timing pulleys 121 and 122 is provided with dust removing blades in the central portion of the belt 123. Predetermined widths of both edges and the both edges on the stretch side portion of the belt 123 (downside portion of FIG. 7) are touched by the guide rollers 155 so that the dust removing belt 123 can be guided into each diametrical inside of the timing pulleys 121 and 122.

The moving member 120 constituted of timing pulleys 121 and 122, the supporting shaft 125 and driven shaft 126, and the dust removing belt 123 are assembled as shown in FIG. 13. The supporting shaft 125 is inserted into and connected with the timing pulley 121 by the locking pin 152 first. The driven shaft 126 is then inserted into and connected with the timing pulley 122 by the locking pin 153.

Next, the dust removing belt 123 is wound between the timing pulleys 121 and 122. In this condition, the driven shaft 126 in the side of the timing pulley 122 is inserted into the guide grooves 150 of the head holder 119. The holder long parts 137 of the holder 119 are then pressed to spread in the direction of arrows C and D. The supporting shaft 125 in the side of the timing pulley 121 is inserted into the supporting holes 154 of the holder 119.

After that, E-type retaining rings 156 are affixed on the both ends of the supporting shaft 125 so as to fix the position of the supporting shaft 125. Also, a coupling member 135 is put in one end of the driven shaft 126 and the coupling member 135 is united with the driven shaft 126 by a locking pin 157. The coupling member 135 is finally put in the coupling member 134 fixed to the second driving shaft 132 of the slider 113. As described above, the dust removing head 118 is assembled. After assembling the dust removing head 118, the stretch side portion of the dust removing belt 123 is touched by the guide rollers 155 so as to as to be guided into each diametrical inside of the timing pulleys 121 and 122.

According to the above embodiment, the locking rail 138 with the wedge portion 138*a* and the locking rail 144 with the wedge portion 144*a* connect the holder 119 of the dust removing head 118 with the slider 113 in the condition that the wedge portions 138*a* and 144*a* are firmly engaged with each other by clamping of the clamping bolt 147. Therefore, the wedge type portions 138*a* and 144*a* can be easily engaged or separated by clamping or releasing of the clamping bolt 147. Furthermore, the connection between the slider 113 and the holder 119 of the dust removing head 118 is done not only by the locking rails 138 and 144, but also by clamping of the clamping bolt 147, to form a secure connection between the slider 113 and the dust removing head 118. Accordingly, the dust removing head 118 can be attached to or detached from the slider 113 easily and securely.

Further, the slider 113 and the holder 119 of the dust removing head 118 are supported by inserting the supporting pin 146 of the slider 113 into the elliptic hole 139 of the holder 119. The connection between the slider 113 and the dust removing head 118 is supported at three points including the connections of the locking rails 138 and 144, and between the holder plate 140 and the clamping bolt 147. Accordingly, the connection between the slider 113 and the dust removing head 118 can be effected more securely.

In the above embodiment, the clamping bolt 147 is used as a clamping member for fixing the slider 113 to the dust removing head 118. However, it is possible to use other materials such as a pin or a spring instead of the clamping member such as a bolt, or the like, for forcing each wedge portion in the clamping direction as long as the wedge type portions 138*a* and 144*a* of the locking rails 138 and 144 used as wedge members are firmly engaged with each other.

In the above embodiment, the guide grooves 150 are formed to extend inside from the bottom edges 151 of the holder basic part 136 so that the driven shaft 126 of the timing pulley 122 can be inserted into the guide grooves 150 and the supporting holes 154 are formed on the holder long part 137 of the holder 119 so that the driven shaft 125 of the timing pulley 121 is put in the supporting holes 154. The supporting shaft 125 can be secured to the timing pulley 121 by using the locking pin 152 and the driven shaft 126 can be secured to the timing pulley 122 by using the locking pin 153 before the dust removing belt 123 is attached to the holder 119 by winding it around both timing pulleys 121 and 122. Accordingly, the timing pulleys 121 and 122, the supporting shaft 125 and driven shaft 126, and the dust removing belt 123 can be attached to or detached from the holder 119 as an unit, and the dust removing head 118 can be easily assembled or disassembled.

Further, the dust removing belt 123 on which the dust removing blades 124 is installed is wound around the timing pulleys 121, 122 and the guide rollers 155, and the stretch side portion of the belt 123 is guided by the guide rollers 155 into each diametrical inside of the timing pulleys 121 and 122. Therefore, the dust removing blades 124 located on the stretch side of the dust removing belt 123 can be accommodated in the holder 119. Accordingly, for the dust removing blades 124 protruding at the both sides of the dust removing belt 123 and oppositely arranged on the stretch side and the loose side of the above belt, the space between the tips of blades becomes smaller. As a result, the thickness of the dust removing head 118 can be reduced from the thickness H' of the conventional structure to the thickness H (FIG. 7) of the described structure. The printing-plate dust removing apparatus can be easily installed in a narrow gap between rollers including the plate cylinder 101.

C. A third embodiment of an apparatus for removing dust from a printing plate of a printing press (FIGS. 14 to 19 which corresponds to claims 4, 7 and 15).

In the third embodiment, the same parts as those of the above second embodiment use the same numerals to omit respective description.

Figure 16:
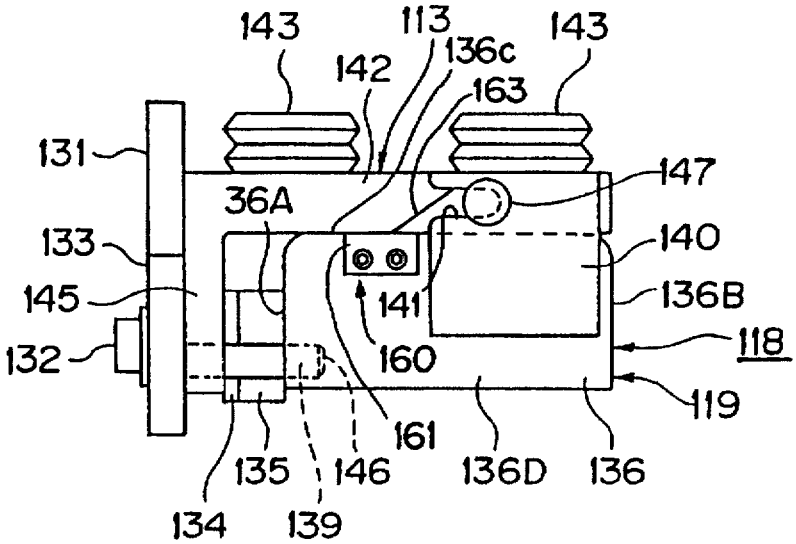
FIG. 16 shows a section that it is seen from arrow XVI of FIG. 15.
Figure 17B:
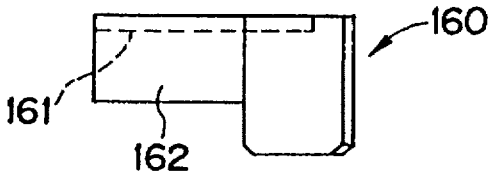
FIG. 17 shows a spring plate of FIG. 16; (A) is a front view, (B) is a plan view, (C) is a left side view, (D) is a right side view and (E) is a perspective view.
Figure 17C:
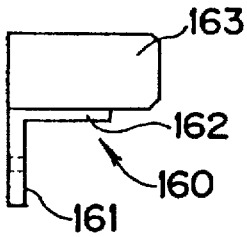
Figure 17A:
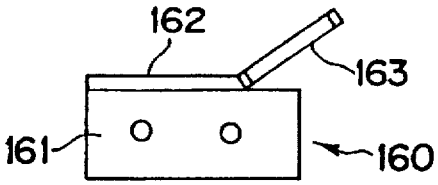
Figure 17D:
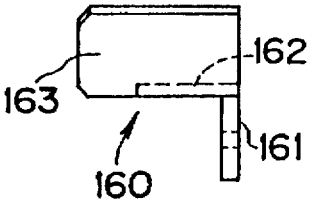
Figure 17E:
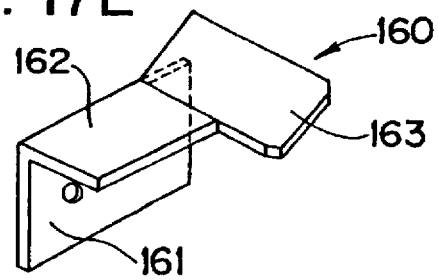

In the dust removing head 118 of the printing-plate dust removing apparatus according to the third embodiment, as shown in FIG. 16, a spring plate 160 as a separation-preventative member for the clamping bolt 147 is fixed on the back side 136D of the holder basic part 136 of the holder 119. The spring plate 160 is located adjacent to the holder plate 140.

As shown in FIG. 17, the spring plate 160 is constituted so that a connector portion 162 is bent substantially in the vertical direction relative to a base portion 161, a flap portion 163 is bent obliquely relative to the connector portion 162, and the base portion 161 is fixed on the holder basic part 136. In the condition that the spring plate 160 is attached, the flap portion 163 can lock the clamping bolt 147 of the slider 113, which is inserted into the inserting groove 141 of the holder plate 140. For this reason, even if the dust removing head 118 is slightly moved along the locking mils 144 and 138 relative to the slider 113, the clamping bolt 147 will strike the flap portion 163 of the spring plate 160 to prevent the dust removing head 118 from falling off the slider 113. As a result, the dust removing head 118 can be securely attached to the slider 113.

Figure 14:
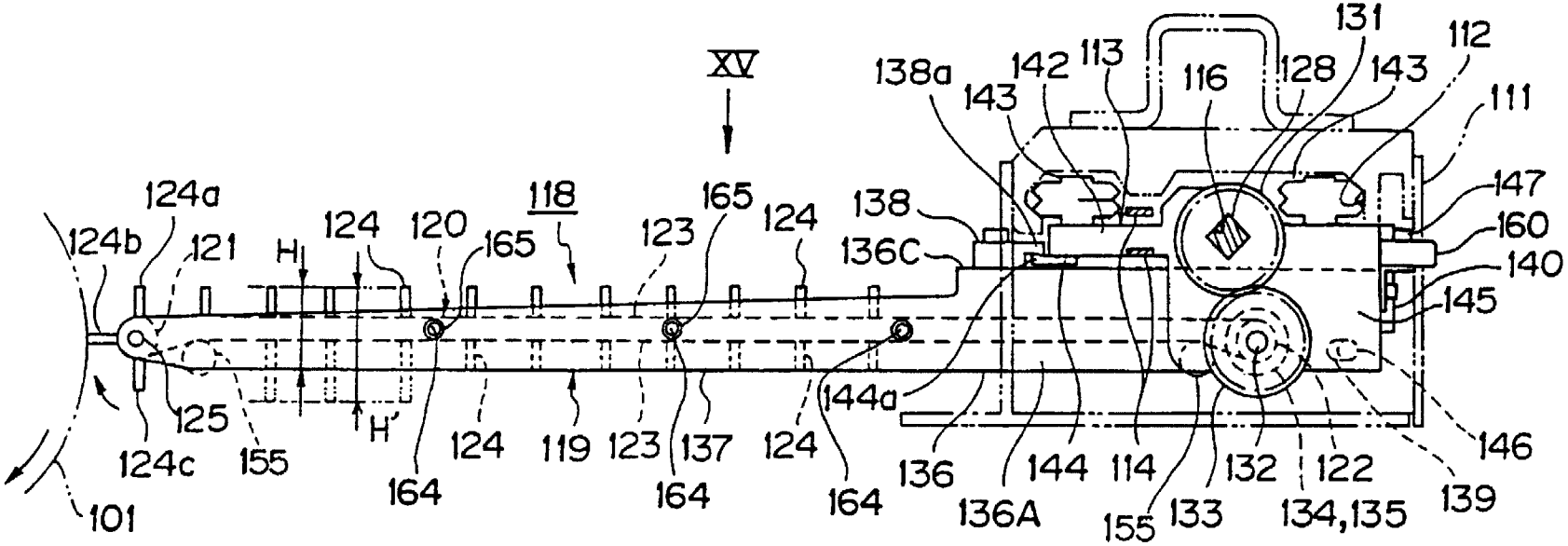
FIG. 14 is a side view of an apparatus for removing dust from a printing-plate of printing press according to a third embodiment of the invention.
Figure 15:
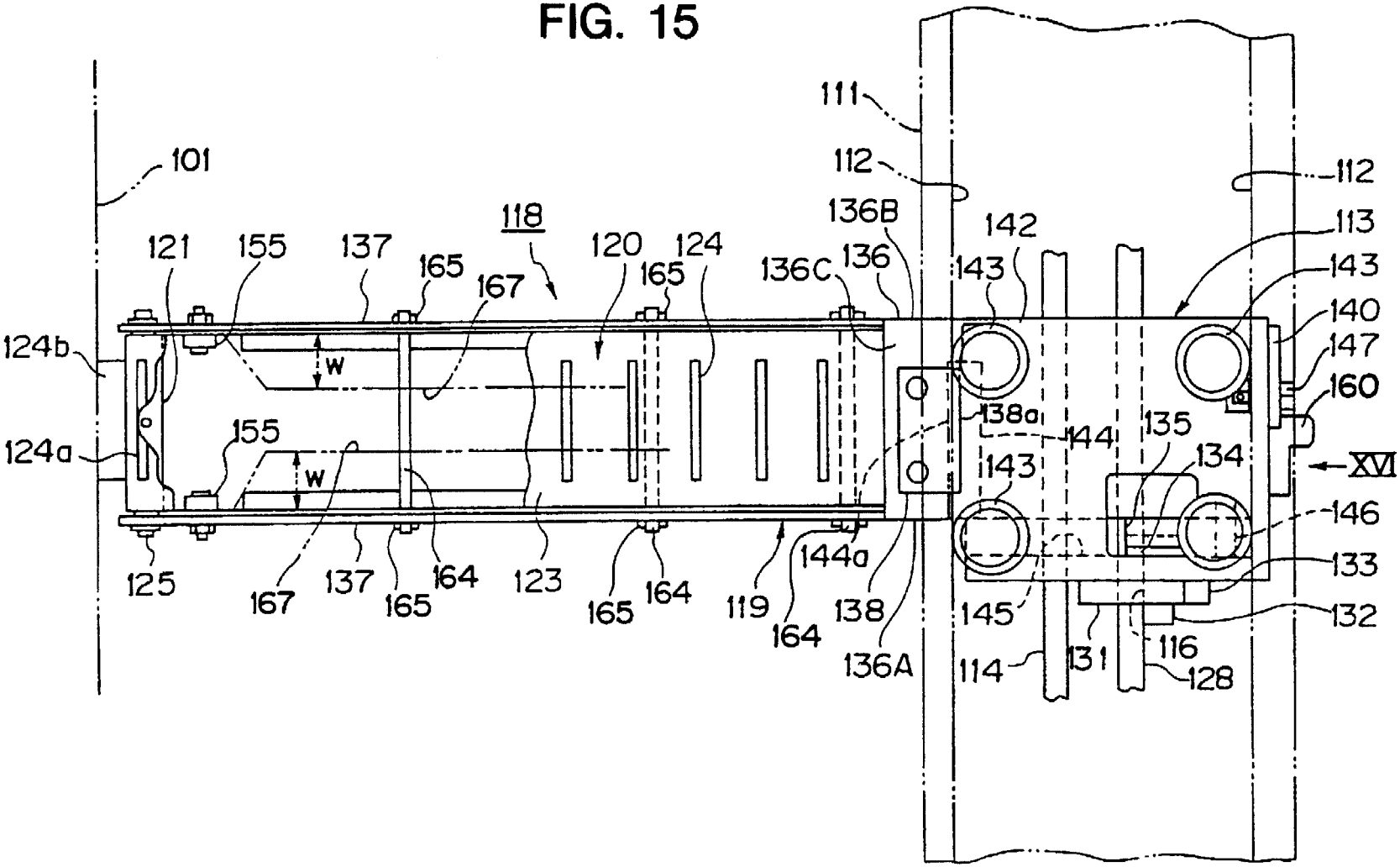
FIG. 15 shows a section that it is seen from arrow XV of FIG. 14.
Figure 18:
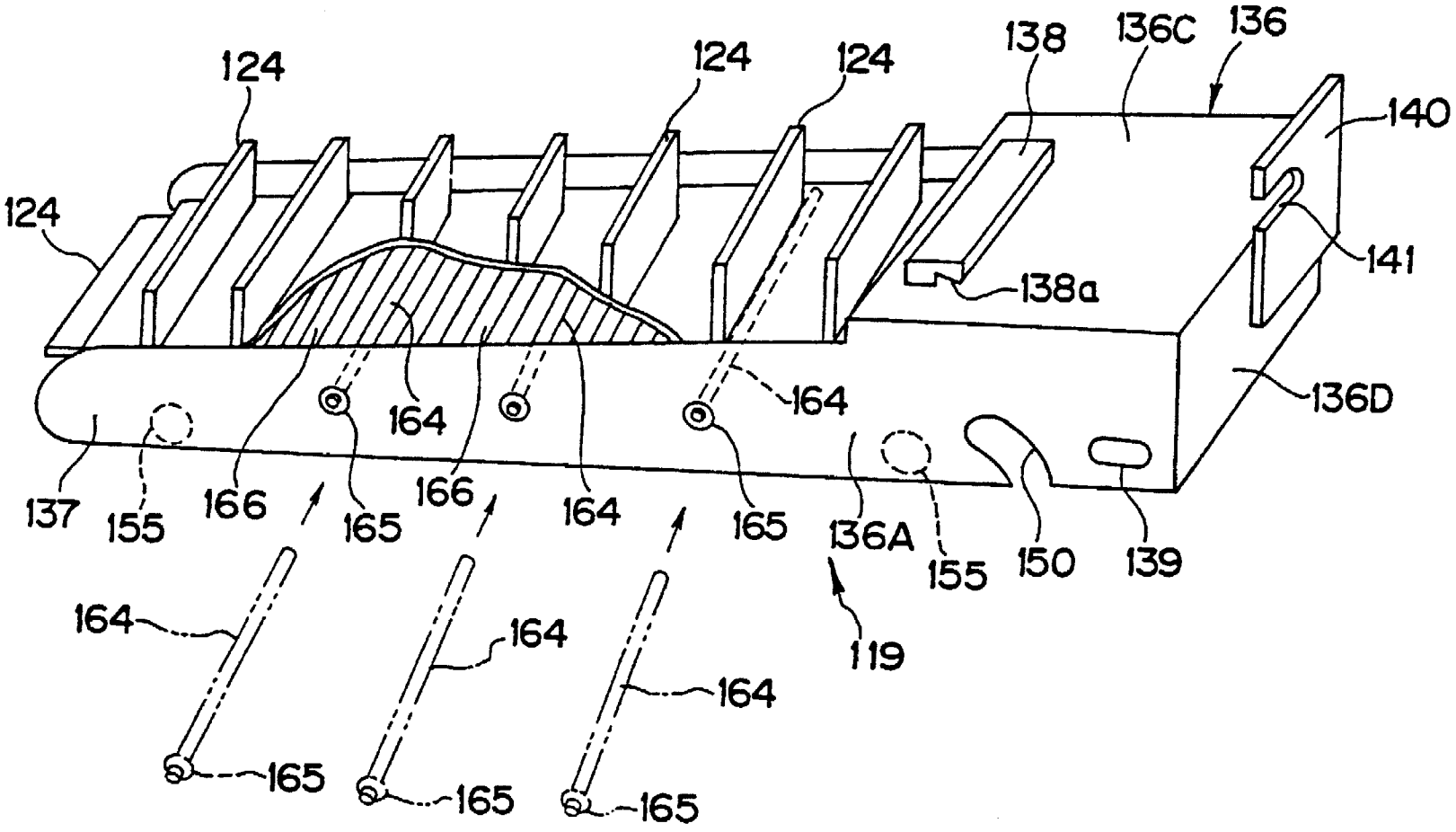
FIG. 18 is a perspective view showing partially in section in the dust removing head of FIG. 14.

Further, in the printing-plate dust removing apparatus, as shown in FIGS. 14, 15 and 18, the holder 119 is equipped with a plurality (three shown) anti-biting rods 164 between the holder long parts 137 on the holder 119. The anti-biting rods 164 are located between the feed-side dust removing belt 123 (upside belt of FIG. 14) and the return-side dust removing belt 123 guided by the guide rollers 155 (downside belt of FIG. 14) so that the distance of the holder long parts 137 is divided into three at equal distances in the long side direction thereof, with the width between the guide rollers 155. The both ends of the anti-biting rods 164 are respectively prevented from falling off the holder long parts 137 by retaining rings 165.

Figure 19A:
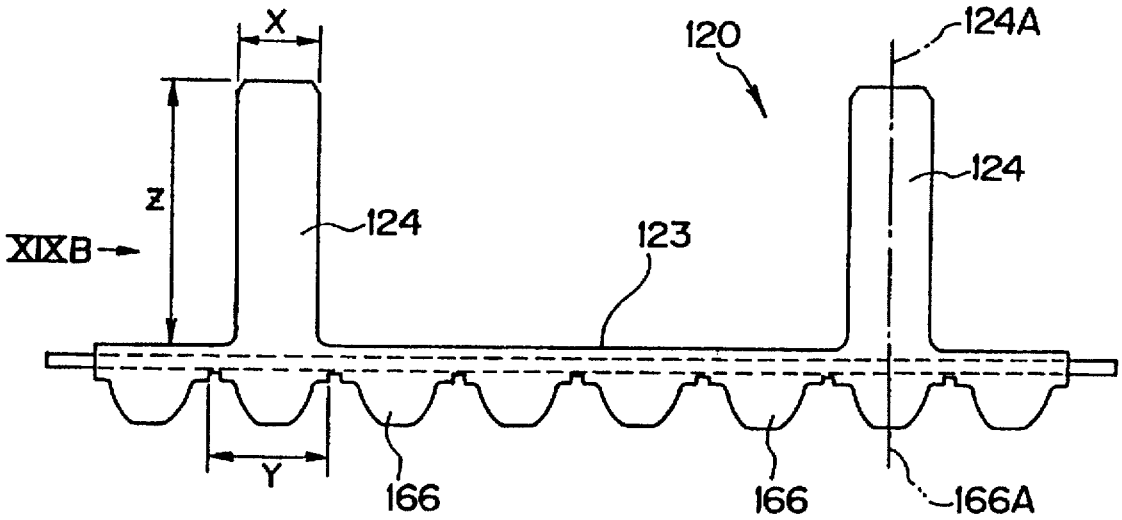
FIG. 19 shows a dust removing belt of FIG. 14; (A) is a front view, (B) is a view from arrow XIXB of (A) and (C) is a view from arrow XIXC of (B)

The dust removing belt 123, as shown in FIG. 19(A), is a timing belt forming many teeth 166 on the back side (fresh side) thereof. The teeth 166 transmit driving power by being engaged with the teeth provided on the outer peripheral surface of the timing pulleys 121 and 122. The diameter of the above anti-biting rods 164 shown in FIG. 18 is set to be a minimum value but to be equal to or more than the tooth pitch on the above dust removing belt 123. For example, if the tooth pitch on the dust removing belt 123 is 3 mm, the diameter of the anti-biting rods 164 is then set to about 3 mm.

Accordingly, the upside dust removing belt 123 and the downside dust removing belt 123 can be prevented from being engaged with each other by the above anti-biting rods 164, and the dust removing belt 123 can be properly operated.

In addition, the anti-biting members may use anti-biting plates 167 shown by two-dot chain lines in FIG. 15. The anti-biting plates 167 are fixed inside the two holder long parts 137 of the dust removing head 118. Each of the anti-biting plates 167 is then located between the upside dust removing belt 123 and the downside dust removing belt 123, guided by the guide rollers 155 in the long side direction of the holder long parts 137. Each width W of the anti-biting plates 167 protruding inside between the guide rollers 155 is set so that the dust removing belt 123 can be attached or detached smoothly, e.g., to about 5–10 mm. Also, the both ends of the respective anti-biting plates 167 are cut at an angle so that the teeth 166 of the dust removing belt 123 do not bite into the anti-biting plates 167. Accordingly, the anti-biting plates 167 can also function in the same manner as the anti-biting rods 164.

Figure 19B:
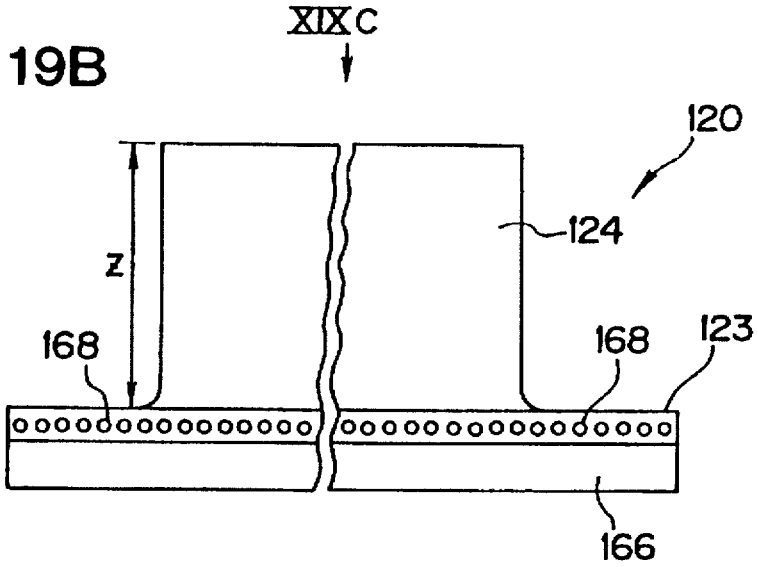
Figure 19C:
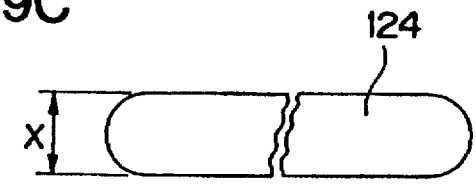

The above dust removing belt 123, as shown in FIG. 19, is united with the dust removing blades 124.

That is, the dust removing belt 123 is formed, for example, so that a core material 168 of polyester is inserted into synthetic resin such as polyurethane or the like and is united with the dust removing blades 124 made of the same polyurethane to constitute a unit. The dust removing blades 124 are provided on the front side of the dust removing belt 123 so as to correspond to the teeth provided on the back side of the dust removing belt 123. In this embodiment, the central axis 124A of each dust removing blade 124 is located so as to correspond to the central axis 166A of each tooth 166.

Further, the width X of the dust removing blades 124 is set to be equal to the pitch of the teeth 166 or less, for example, to about 2 mm. The height Z of the dust removing blades 124 is set so that the tip of the dust removing blade 124 is slightly bent by striking the plate cylinder 101 at the working position of the dust removing blades 124 in consideration of the distance between the plate cylinder 101 and the timing pulley 121 provided in the side of the plate cylinder 101, for example, to about 6.5 mm.

As discussed above, the dust removing blades 124 are formed on the dust removing belt 123 to be a unit. They are provided at positions which correspond to those of the respective teeth 166 of the dust removing belt 123. Therefore, the dust removing belt 123 can be wound around timing pulleys 121 and 122 with a smaller radius of curvature. Accordingly, a thinner dust removing head 118 can be achieved.

D. A first embodiment of a printing plate dust removing system (FIGS. 20 to 22, which corresponds to claims 8 and 12).

Figure 20:
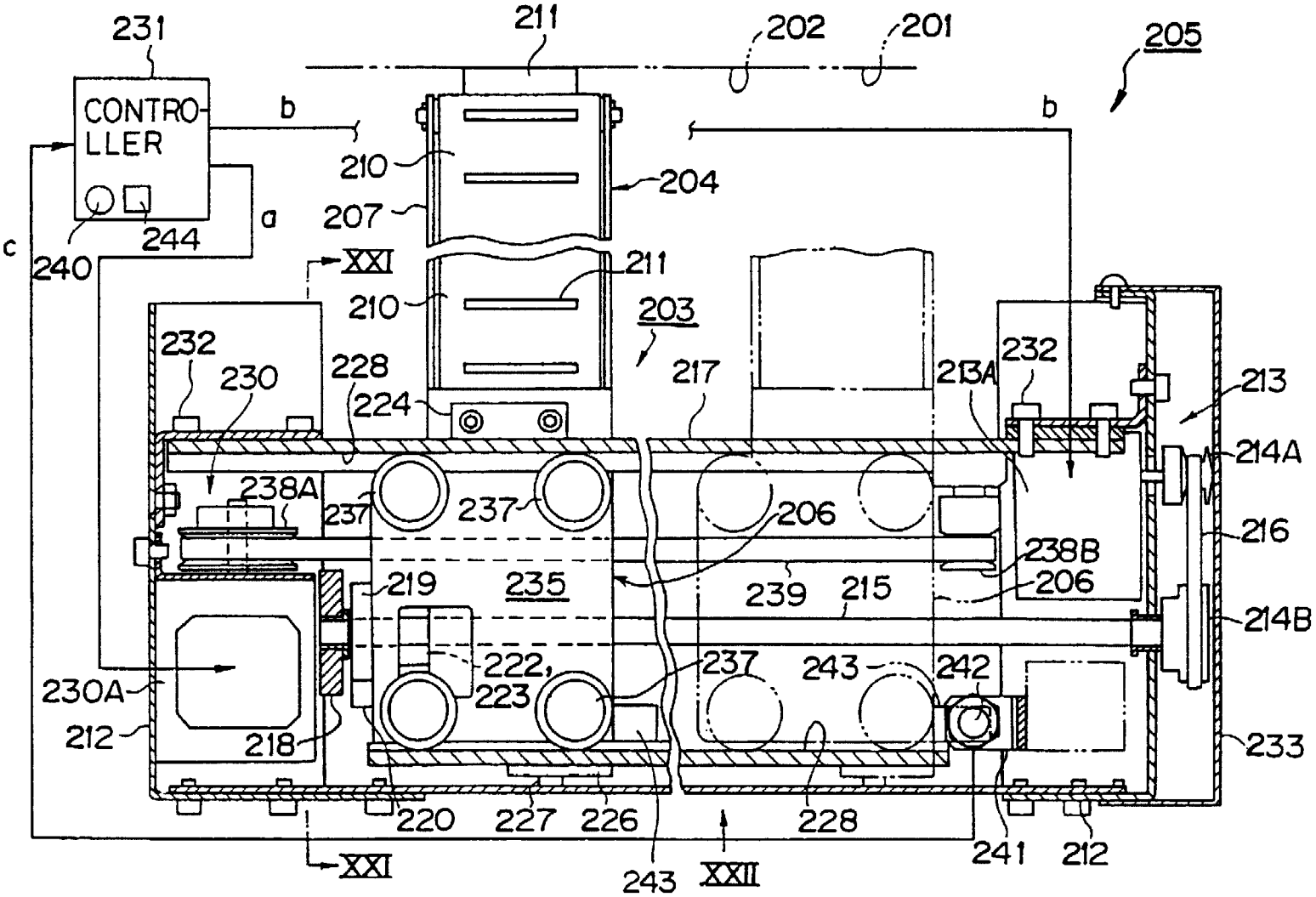
FIG. 20 is a cross-sectional view taken along line XX—XX of FIG. 21 showing a system for removing dust from a printing-plate of printing press according to a first embodiment of the invention.
Figure 21:
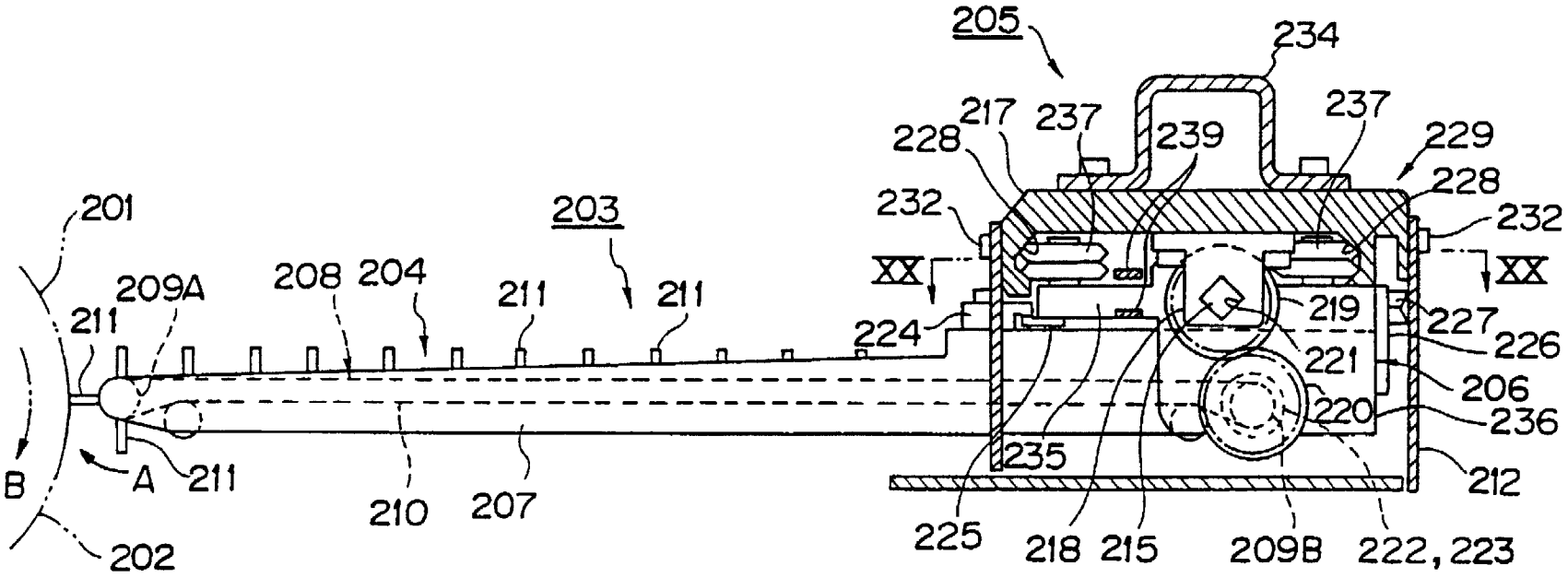
FIG. 21 is a cross-sectional view taken along line XXI—XXI of FIG. 20.

As shown in FIGS. 20 and 21, a printing plate 202 is provided on the surface of a plate cylinder 201 of a printing press so that a printing-plate dust removing apparatus 203 removes ink or paper dust which adheres to the printing plate 202. The printing-plate dust removing apparatus 203 and a control system constitute a printing-plate dust removing system 205. The control system includes a controller 231 and a detecting sensor 242. The printing-plate dust removing apparatus 203 includes a dust removing head 204, a driving gear 213, a slider 206, guide rails 228 and a moving device 230.

The dust removing head 204 includes a holder 207 capable of being attached to or detached from the slider 206 and a moving member 208 supported by the holder 207. The moving member 208 has a dust removing belt 210 which is wound around two timing pulleys 209A and 209B supported by the holder 207 and a plurality of dust removing blades 211 which is provided outside on the belt 210 with equal pitches.

Figure 22:
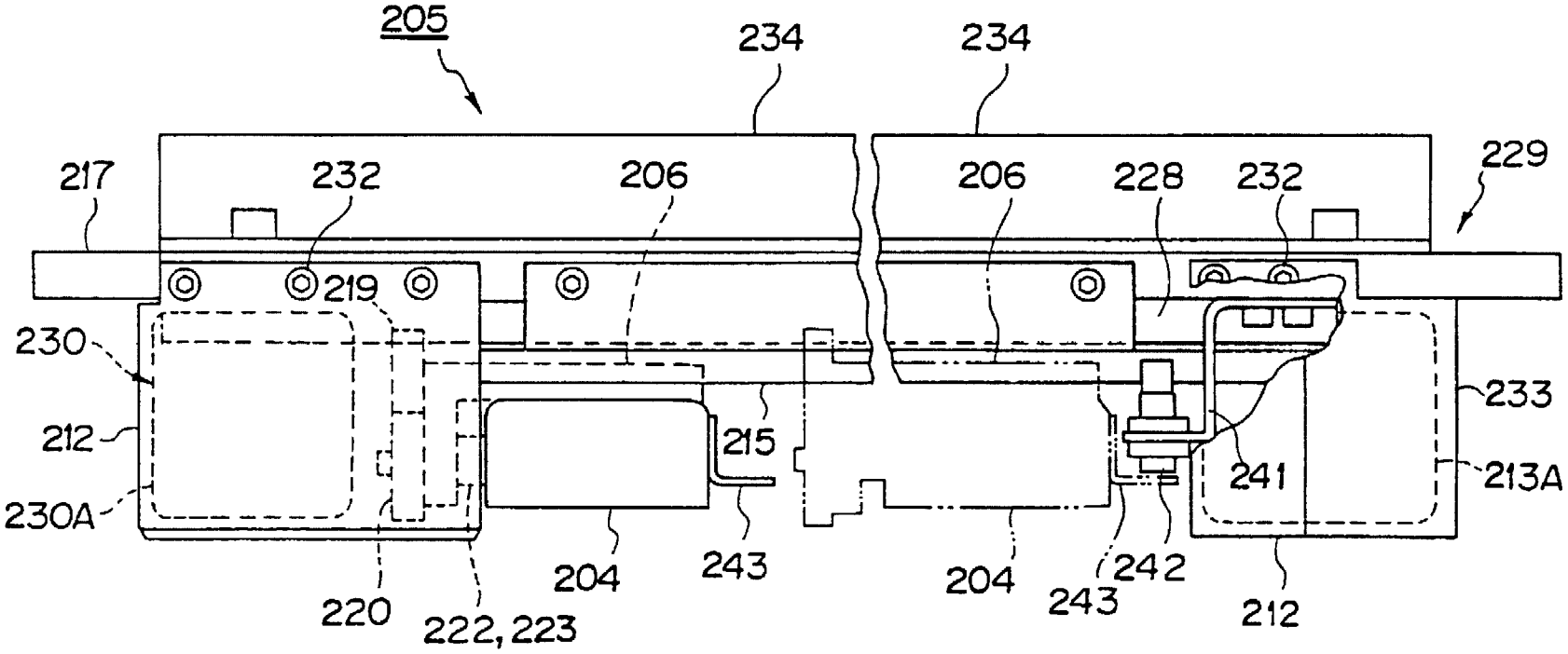
FIG. 22 shows a section that is seen from arrow XXII of FIG. 20.

On the other hand, a machine mount 229, as shown in FIGS. 20, 21 and 22, includes a supporting frame 212 and a rail frame 217. The driving gear 213 for driving the above moving member 208 is then placed in the supporting frame 212. The driving gear 213 is constituted so that a pulley 214A is fixed to a rotational shaft of a stepping motor 213A which is placed in the supporting frame 212. Another pulley 214B is fixed at an end of a first driving shaft 215 and a power transmission belt 216 is wound around both pulleys 214A and 214B. The first driving shaft 215 has a four-cornered cross section and it is rotatably supported by the supporting frame 212 while being rotatably supported through a shaft bracket 218 by the rail frame 217.

Also, gears 219 and 220 are rotatably supported by the slider 206 relative to their shaft at any time. The above first driving shaft 215 is engaged with a four-cornered hole 221 of the gear 219 and the gear 220 is connected with the above timing pulley 209B through coupling members 222 and 223.

Accordingly, when the stepping motor 213A in the driving gear 213 is intermittently rotated, the intermittently rotational power is transmitted to the first driving shaft 215 through the pulleys 214A, 214B and the power transmission belt 216, then, to the timing pulley 209B through the gears 219, 220 and the coupling members 222, 223. The dust removing belt 210 is then shifted intermittently in the direction of arrow A shown in FIG. 21 by the intermittent rotation of the above timing pulley 209B to select a working position where one of the dust removing blades 211 on the dust removing belt 210 is in contact with the printing plate 202 on the plate cylinder 201 and a standby position where the dust removing blade 211 is not in contact with the printing plate 202. If the dust removing blade 211 is located at the working position, ink dust etc. on the printing plate 202 is removed by the dust removing blade 211 which is in contact with the printing plate 202 since the plate cylinder 201 rotates itself in the direction of arrow B shown in FIG. 20.

The dust removing head 204 is shifted to the dust position where ink dust etc. adheres onto the printing plate 202 by using the slider 206 and the moving device 230. The dust removing head 204 is attached to the slider 206 capable of moving along the guide rails 228 discussed below so that the dust removing head 204 can be installed on or removed from the slider 206.

In the above machine mount 229, the rail frame 217 is fixed over the supporting frame 212 by using fitting bolts 232. The guide rails 228 as guide members are formed inside the rail frame 217 in the axial direction along the plate cylinder 201. A side cover 233 is fixed to the supporting frame 212 to cover the pulleys 214A, 214B, and the power transmission belt 216. Also, a reinforcing frame 234 is fixed over the rail frame 217 by bolts.

The slider 206 includes a top portion 235 and side portion 236 which are formed as an unit having an angle-like cross section. A plurality of rollers 237 are provided on the top portion 235. The rollers 237 are disposed in guide rails 228 so that the slider 206 can be shifted in the axial direction of the plate cylinder 201. Also, the gears 219 and 220 are supported by the side portion 236 of the slider 206 relative to their shaft.

The holder 207 of the dust removing head 204 is fixed to the slider 206 by using locking rails 224, 225, a holder plate 226, a clamping bolt 227, or the like, so that the holder 207 can be installed on or removed from the slider 206. The locking rail 224 is fixed on the top side of the holder 207, the locking rail 225 is fixed in the front side of the top portion 235 of the slider 206, and each connecting portion of both the locking rails 224 and 225 is formed into a wedge shape. The holder plate 226 is then fixed on the back side of the holder 207 and the clamping bolt 227 is clamped on the back side of the top portion 235 of the slider 206. The holder plate 226 is fixed on the top portion 235 of the slider 206 by clamping of the clamping bolt 227, while the locking rails 224 and 225 are firmly connected by engaging the wedge portions with each other.

The above moving device 230 includes a stepping motor 230A fixed to the supporting frame 212, a pulley 238A fixed to the motor shaft of the stepping motor 230A, another pulley 238B rotatably supported by the supporting frame 212, and a slider moving belt 239 which is wound around the pulleys 238A and 238B. The slider moving belt 239 is fixed on the back side of the top portion 235 of the slider 206. The slider 206 can slide a predetermined distance along the guide rails 228 through the slider moving belt 239, and the like, as the stepping motor 230A rotates forward and backward. During this slide, the gear 219 supported by the slider 206 slides in the axial direction of the first driving shaft 215 when the gear 219 is engaged with the first driving shaft 215.

The controller 231 outputs a pulse signal a to the stepping motor 230A in the moving device 230, and outputs a driving pulse signal b to the stopping motor 213A in the driving gear 213 so that the slider 206 and the dust removing head 204 are moved to a target position to shift the dust removing belt 210 of the dust removing head 204 intermittently a predetermined amount. In other words, when a dust removing specifying button 240 of the controller 231 has been set by an operator, the controller 231 outputs a shift pulse signal a which gives the number of pulses determined in response to the difference between the current presumed position of the slider 206 and the target position set by the dust removing specifying button 240 so as to shift the slider 206 and then the dust removing head 204 is set to the specified position. During this shift, the corresponding dust removing blade 211 selects the standby position where the blade 211 is not in contact with the printing plate 202 on the plate cylinder 201. After the dust removing head 204 has been set to the specified position, the dust removing belt 210 is rotated intermittently by the driving pulse signal b and the dust removing blade 211 selects the working position where the blade 211 is in contact with the printing plate 202. Therefore, ink dust etc. which has adhered onto the printing plate 202 is scraped and removed by the rotation of the plate cylinder 201.

The above controller 231 determines the shifting amount of the slider position from the reference position of the slider 206 by counting the number of pulses for the shift pulse signal a. Accordingly, the controller 231 presumes the position of the slider 206 by counting the number of pulses for the shift pulse signal a and it sets the slider 206 to the target position based on the above presumed position. The controller 231 also outputs the shift pulse a for shifting the slider 206 periodically in one side direction of the stroke end (two-dot chain line position of FIGS. 20 and 22) to the stepping motor 230A in the moving mechanism 230 continuously and it stops the output of the shift pulse signal a by a detection signal from the detecting sensor 242.

On the other hand, in the rail frame 217 of the machine mount 229, a sensor bracket 241 is mounted in the down side direction of FIG. 22 at which the detecting sensor 242 is located. The detecting sensor 242 senses a plate 243 fixed to the head holder 207 of the dust removing head 204 when the slider 206 has reached a position on the side of the stroke end discussed above. Then it outputs the detected signal c to the controller 231.

When the slider 206 and dust removing head 204 are in a position detected by the detecting sensor 242, and the detected signal c has been output, if an actual position of the slider 206 differs from the presumed position of the slider 206 recognized within the controller 231 at the output time, the controller will alarm and correct the gap (difference). That is, when the sense plate 243 has been sensed by the detecting sensor 242 at the position where the slider 206 has reached just this side of one stroke end, if a theoretical value in which the number of times the shift pulse signal a has been then counted differs from the actual value of the number of pulses in the case the sense plate 243 is regarded as being at the position where it can be sensed by the detecting sensor 242, the controller 231, for example, alarms and corrects the difference to 0.

According to the above embodiment, the detecting sensor 242 is placed in the rail frame 217 on the machine mount 229 to detect the actual position of the slider 206. Then, the controller 231 presumes the position of the slider 206 and compares the presumed position with the actual position detected by the detecting sensor 242. If the gap (difference) is generated between the presumed position and the actual position, the controller 231 alarms and corrects the gap, and this makes it possible to regard the presumed position as not having any error relative to the actual position. As a result, the presumed position of the slider 206 can be presumed accurately and the slider 206 and the dust removing head 204 can be set to the target position securely.

If the controller 231 alarms but does not correct the gap (difference), the operator may correct the gap manually based on the alarm, or the controller 231 may correct the gap without giving any alarm.

Further, in this embodiment, although the controller 231 compares the presumed position of the slider 206 with the actual position thereof by shifting the slider 206 periodically in the direction of the stroke end, as discussed above, the controller 231 may compare the presumed position with the actual position at the time when the slider 206 moves in one side direction of the stroke end so that the sense plate 243 is sensed by the detecting sensor 242 after the operator actuates a detection start button 244 of the controller 231. It may then alarm, or correct the position without giving any alarm.

Further, since the guide rails 228 for guiding the slider 206 are formed inside the rail frame 217, the guide rails 228 do not have outside exposure and, therefore, the guide rails 228 is not easily stained with ink and the slider 206 can be shifted smoothly.

In addition, in the above embodiment, the setting position of the detecting sensor 242 shows an example and it can take any of positions which are within a shift range of the slider 206. For example, if the detecting sensor 242 is located near the central position of the shift range of the slider 206, the gap between the actual position and the presumed position can be detected as the slider 206 passes through the detecting sensor, and the number of the detecting sensors can select two or more.

Further, in this embodiment, although the correction of the presumed position is performed where the slider 206 is shifted horizontally, it may be performed where the slider 205 is shifted vertically, or where it moves in an arc or on a circle.

E. A second embodiment of a printing-plate dust removing system (FIGS. 23 to 31, which corresponds to claims 9, 10, 11, 13 and 14).

In the second embodiment, the same parts as those of the printing-plate dust removing system according to the above first embodiment use the same numerals to avoid repetition.

Figure 24:
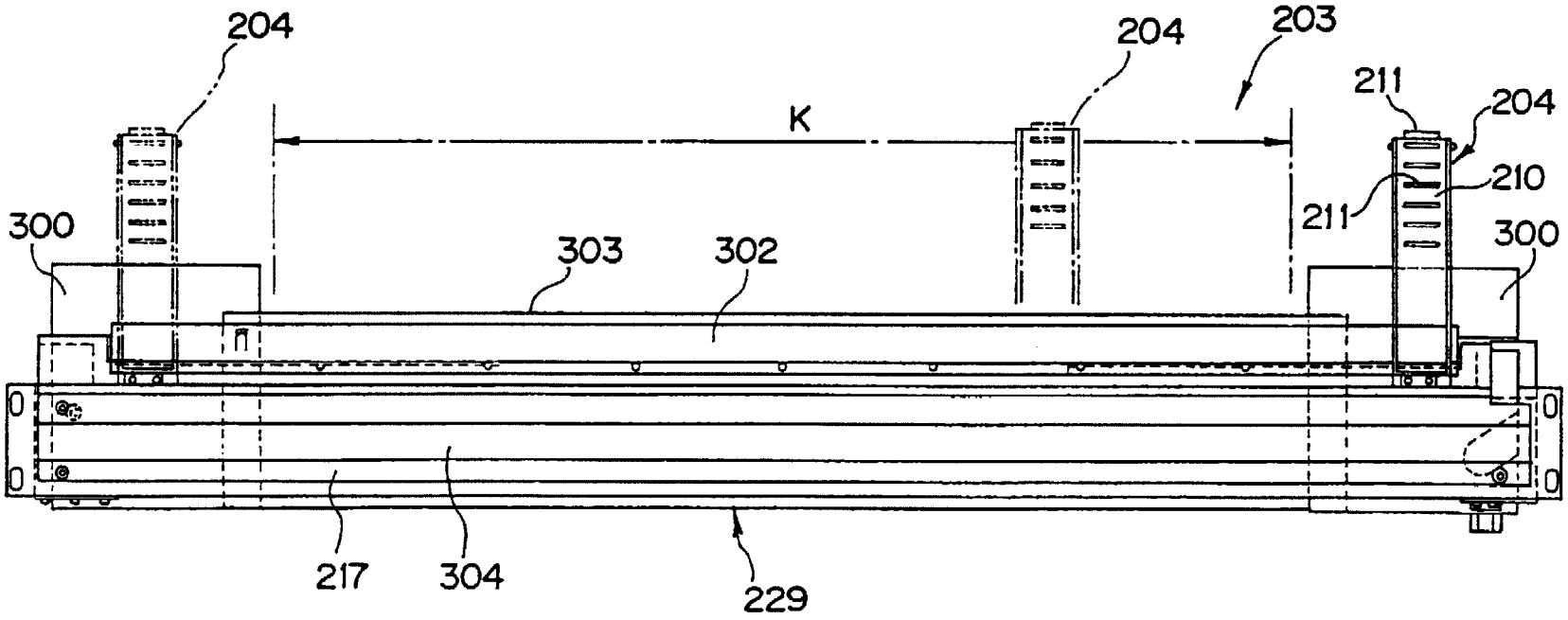
FIG. 24 shows a section that it is seen from arrow XXIV of FIG. 25.
Figure 25:
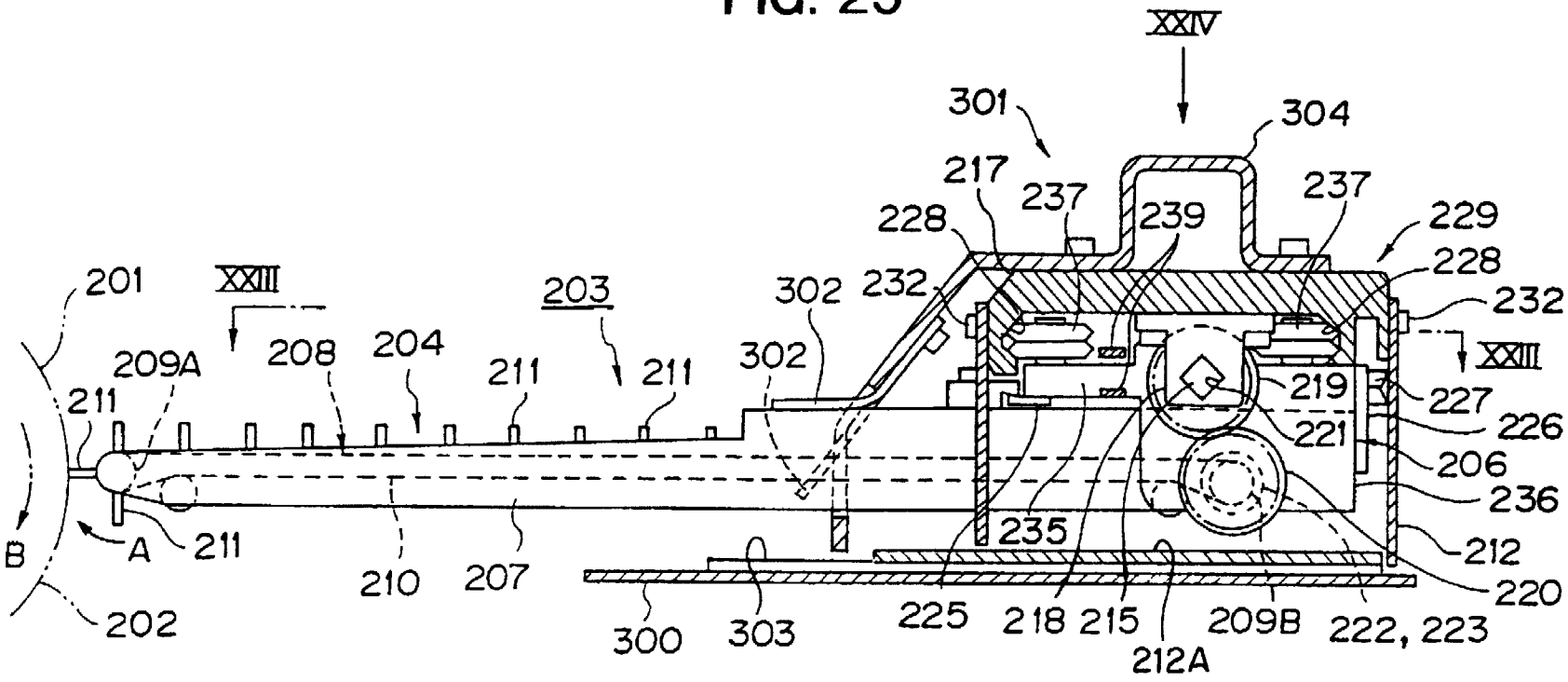
FIG. 25 is a cross-sectional view taken along line XXV—XXV of FIG. 23.
Figure 26:
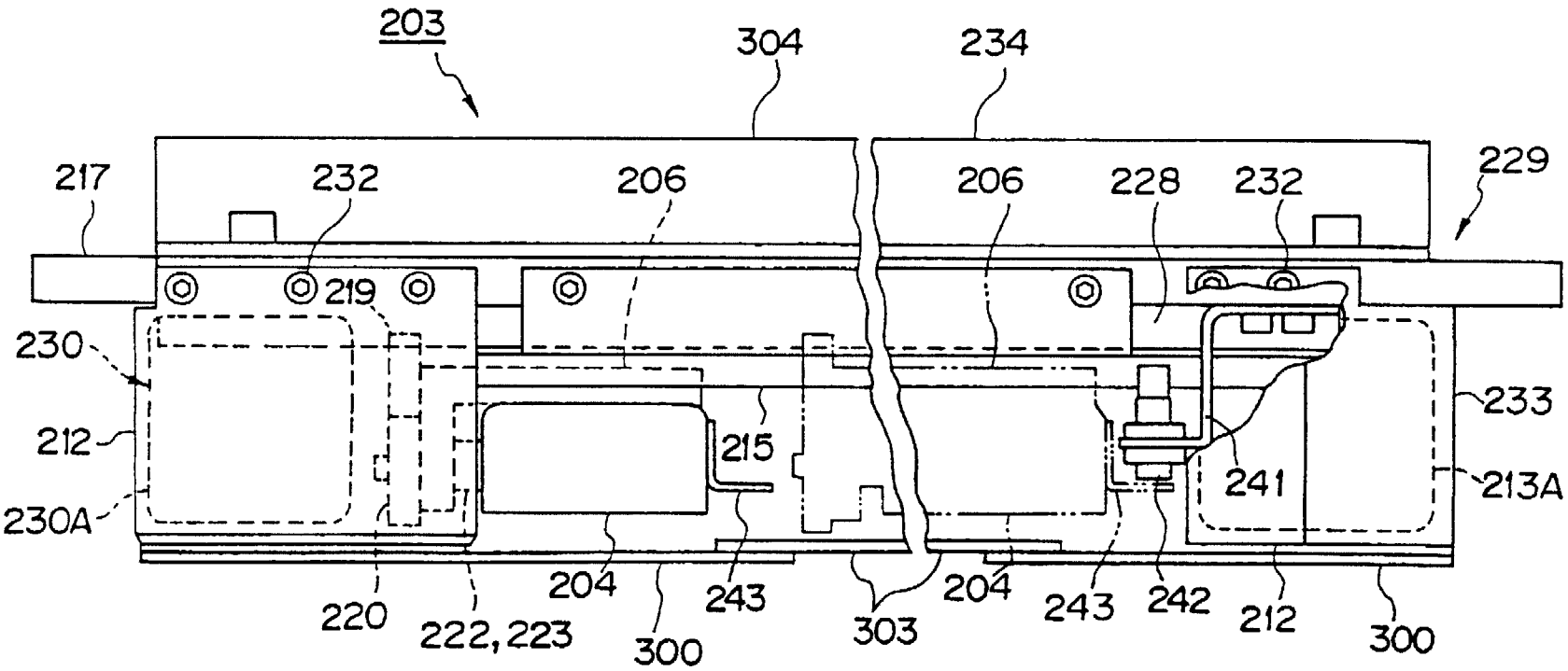
FIG. 26 shows a section that is seen from arrow XXVI of FIG. 23.

In a printing-plate dust removing system 301 according to this embodiment, as particularly shown in FIGS. 24 and 25, a second shielding plate 302 is provided on the rail frame 217 of the machine mount 229 in the printing-plate dust removing apparatus and a first shielding plate 303 is provided on a supporting plate 300 fixed to the supporting frame 212.

The first shielding plate 303 is in the form of a film or a sheet and it is located so as to be opposite to the guide rails 228, showing FIG. 25, and extends toward the plate cylinder 201. Also, the first shielding plate 303, as shown in FIG. 24, is extended along an area K which eliminates both ends of the longitudinal direction of the guide rails 228 out of the whole area where the slider 206 and the dust removing head 204 can be shifted along the guide rails 228.

On the other hand, a reinforcing frame 304 for the rail frame 217 extends obliquely toward the bottom side 212A of the supporting frame 212 in comparison with the reinforcing frame 234 of the above first embodiment and the above second shielding plate 302 is fixed on the back surface of the reinforcing frame 304. Accordingly, the second shielding plate 302 is located obliquely in the lower direction relative to the first shielding plate 303. The second shielding plate 302 is extended along the longitudinal direction of the guide rails 228. The second shielding plate 302 is formed of a flexible material such as natural or synthetic rubber so that the second shielding plate 302 is lifted up by the dust removing head 204 when the dust removing head 204 is shifted along the guide rails 228.

Figure 23:
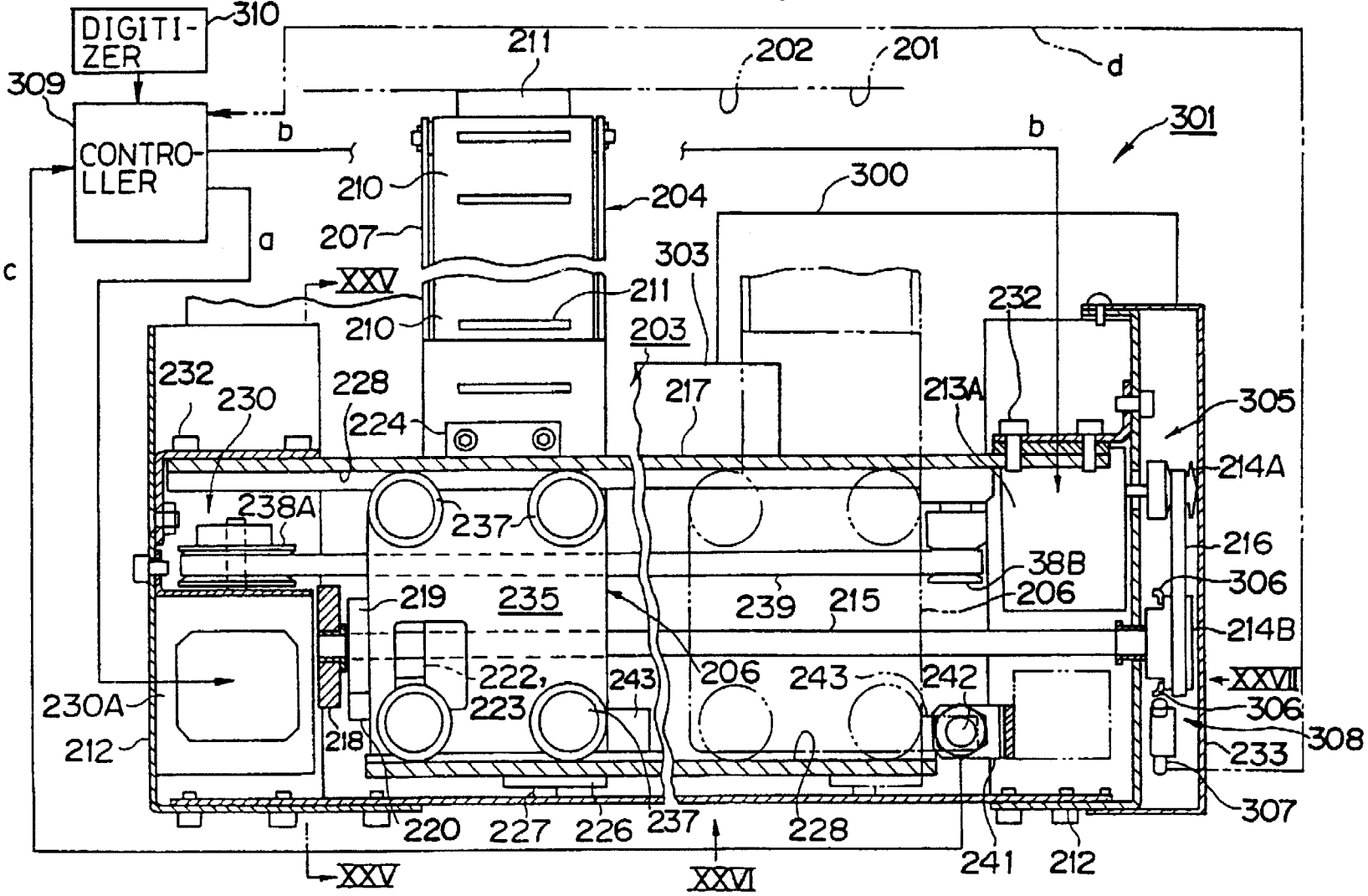
FIG. 23 is a cross-sectional view taken along line XXIII—XXIII of FIG. 25 showing a system for removing dust from a printing-plate of printing press according to a second embodiment of the invention.
Figure 27:
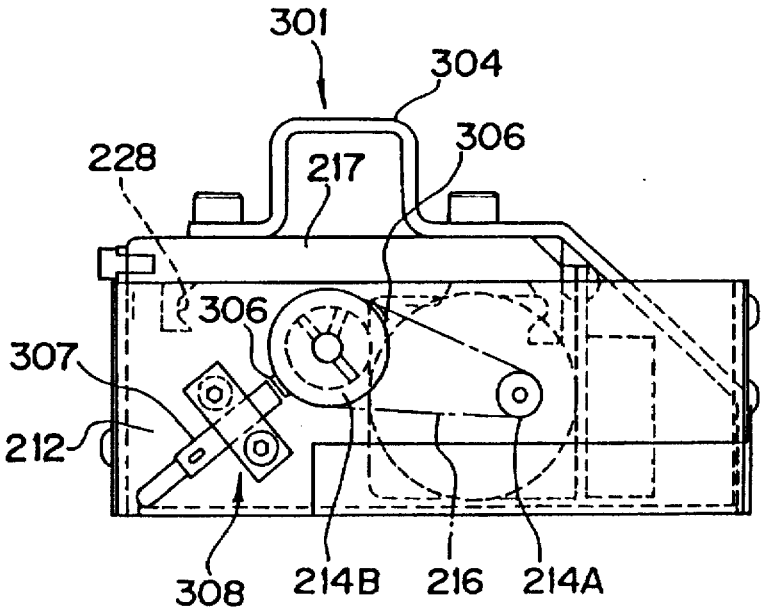
FIG. 27 shows a section that is seen from arrow XXVII of FIG. 23.
Figure 28:
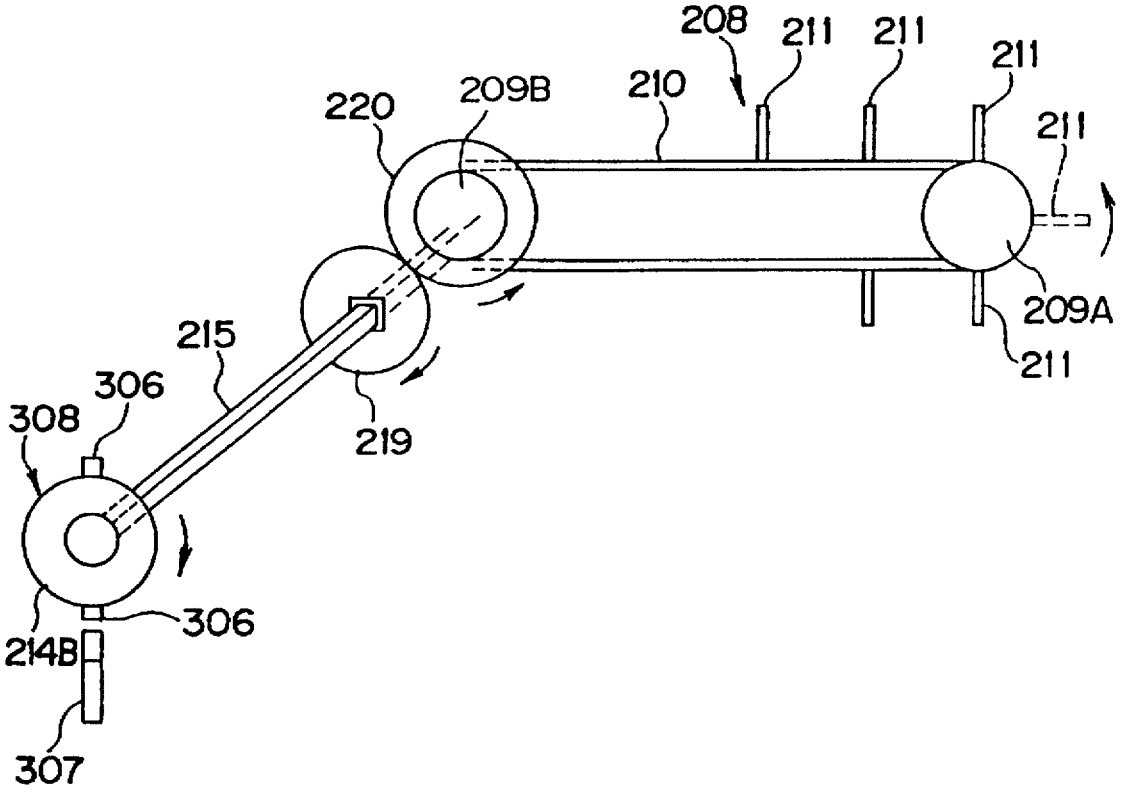
FIG. 28 is a diagram showing a configuration of a dust removing belt driving system of FIG. 23.

Further, a driving gear 305 of each printing-plate dust removing apparatus 203 in the printing-plate dust removing system 301, as shown in FIGS. 23 and 27, is provided with a blade position detecting device 308 as a detecting means including dogs 306 and a proximity sensor 307. The dogs 306 are fixed on the outer periphery of the pulley 214B so as to form a pair which are opposite to each other at 180°, as shown in FIG. 28. The proximity sensor 307 is fixed to the supporting frame 212 (FIG. 27) and then, the dogs 306 and the proximity sensor 307 are covered with the side cover 233 (FIG. 23).

The rotational ratio between the timing pulleys 209A, 209B and the pulley 214B is set in 1 to 1. The dust removing belt 210 has a pitch between the adjacent dust removing blades 211 on the dust removing belt 210 which is wound around the timing pulleys 209A and 209B corresponds to a half-circumference of the pitch circle of the timing pulleys 209A and 209B. Accordingly, the proximity sensor 307 can be set so as to detect the dogs 306 when the dust removing blades 211 are located at the standby positions shown by full line in FIG. 28, the proximity sensor 307 can detect indirectly that the dust removing blades are in the standby condition by the proximity sensor 307 detecting the dogs 306. The detected signal d is then outputted to controller 309 (FIG. 23).

The controller 309, which is similar to the controller 231 of the above first embodiment, shifts the slider 206 and the dust removing head 204 to a target position by outputting a shift pulse signal a and intermittently shifts the dust removing belt 210 of the dust removing head 204 at a predetermined amount by outputting a driving pulse signal b. The controller 309 inputs the detected signal c from the detecting sensor 242. Therefore, when a gap is generated between the actual position of the slider 206 and the presumed position of the slider 206, and this is recognized within the controller 309, the controller 309 corrects the gap.

Figure 29:
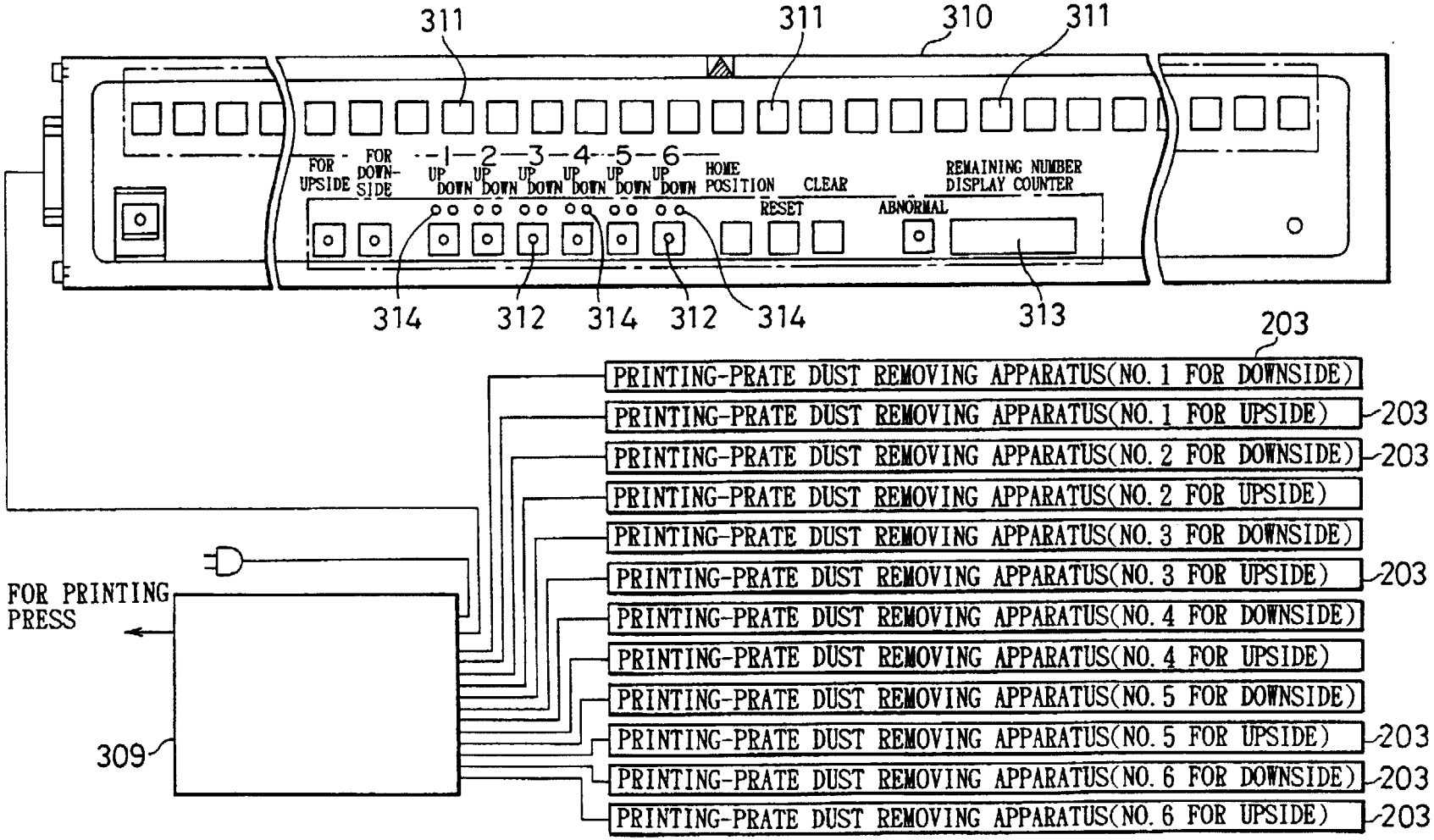
FIG. 29 is a block diagram showing a controller and a digitizer of FIG. 23.

The controller 309 is connected to a digitizer 310 for an input part shown in FIG. 29. The digitizer 310 has a length essentially same as the axial length of the plate cylinder 201 and it is provided with dust removing indicator buttons 311 which are arranged at equal pitches (e.g., 15 mm) along the long side direction of the digitizer 310. When the operator actuates the dust removing indicator buttons 311, the controller 309 then outputs the shift pulse signal a to shift the slider 206 and the dust removing head 204 to the indicated position. On the other hand, the controller 309 is electrically connected with many printing-plate dust removing apparatuses 203 and the digitizer 310 is provided with dust removing apparatus selecting buttons 312 for selecting one of the printing-plate dust removing apparatuses 203. Accordingly, one printing-plate dust removing apparatus 302 is selected by actuating the dust removing apparatus selecting buttons 312. For example, the dust removing indicator buttons 311 are actuated, so that hickey (dust) which adheres to the indicated position on the printing plate 202 of the plate cylinder 201 corresponding the selected printing-plate duct removing apparatus 203 can be removed by the selected printing-plate dust removing apparatus 203.

As shown in FIG. 23, the above controller 309 has a function other than the above one in which the controler 309 outputs the driving pulse signal b so that the driving gear 305 of the printing-plate dust removing apparatus 203 is actuated only when the controller 309 has input the detected signal d from the blade position detecting device 308. In other words, even if the dust removing indicator buttons 311 of the digitizer 310 are actuated by the operator to specify the dust removing position, the controller 309 will stop the dust removing belt 210 rather than shift it intermittently to locate the corresponding dust removing blade 211 at the working position as long as the detected signal d showing that the dust removing blade 211 is located at the standby position is not detected from the proximity sensor 307 of the blade detecting device 308. When the dust removing blade 211 is not located at the standby position, and if the dust removing belt 210 is shifted intermittently so as to locate the dust removing blade 211 at the working position, the dust removing blade 211 cannot be located at the appropriate working position shown by broken line in FIG. 28 and this reduces reliability of the dust scraping. In this case, the operator should correct the position of the dust removing blade 211.

Further, the controller 309 outputs the shift pulse signal a so that the moving device 230 of the printing-plate dust removing apparatus 203 is actuated only when the detected signal d is inputted from the blade position detecting device 308. Then, it shifts the slider 206 and the dust removing head 204. In other words, even if the dust removing indicator buttons 311 of the digitizer 310 are actuated by the operator to specify the dust removing position, the controller 309 will not actuate the moving device 230 to shift the slider 206 as long as the detected signal d showing that the dust removing blade 211 is located at the standby position is not outputted from the proximity sensor 307 of the blade detecting device 308. When the dust removing blade 211 is not located at the standby position, it is considered that the dust removing blade 211 is in contact with the printing plate 202 on the plate cylinder 201. In this condition, if the slider 206 and the dust removing head 204 are shifted, the dust removing blade 211 can damage the printing plate 202. In this case, the operator should correct the dust removing blade 211 by the appropriate position.

Further, the controller 309 can set the stop position of the slider 206 and the dust removing head 204 at will. As shown in FIG. 24, the controller 309 can stop the slider 206 and the dust removing head 204 at any of positions within the area K which eliminates the both ends of the guide rails 228 because ink is scattered intensively over the both ends of the guide rails 228. The stop position is specified by the operator operating the dust removing indicator buttons 311 of the digitizer 310.

The digitizer 310 shown in FIG. 29 is also provided with a count display portion 313. The blade position detecting device 308 shown in FIGS. 27 and 28 has a function other than detecting the standby position of the dust removing blade 211, in which the number of times the dust removing blades 211 on one dust removing belt 210 has performed the dust scraping operation is counted by subtracting the performed times from a predetermined numbers, e.g., 1500 times. The counted value is outputted to the above count display portion 313 so as to be displayed. When the counted value has reached "0", a warning lamp 314 corresponding to the printing-plate dust removing apparatus 203 currently actuated is turned on. The controller 309 prevents the corresponding dust removing belt 210 from further use and stops the dust removing head 204 at the stop position even if the dust removing position is specified by the degitizer 310. After that, the operator should exchange the dust removing head 204. Further, an alarm may be given together with a blinking warning lamp 314 at the time when the counted value comes near "0", e.g., 50 times.

Figure 30:
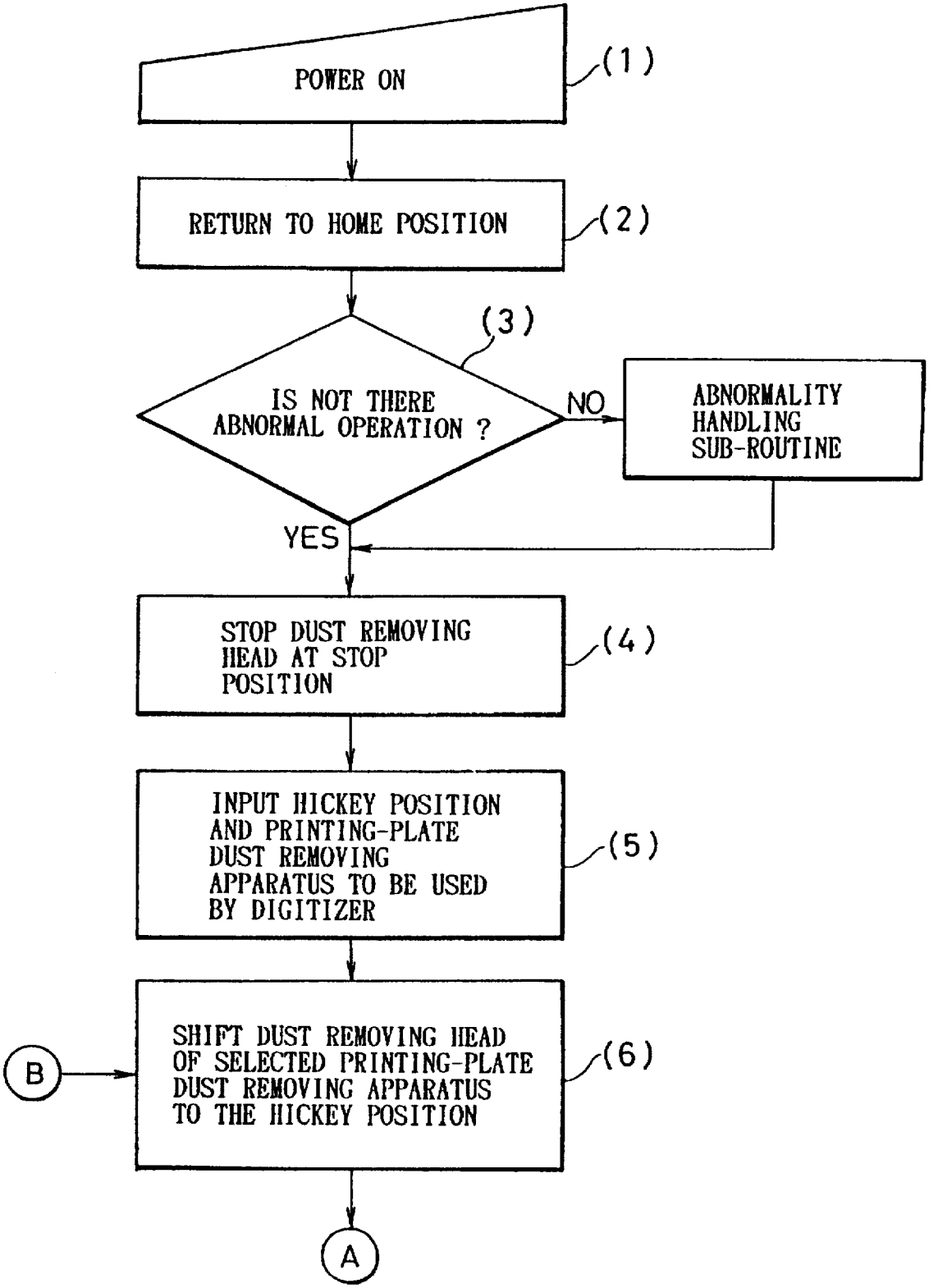
FIG. 30 is a partial flow chart showing an operation of the printing-plate dust removing system of FIG. 23.
Figure 31:
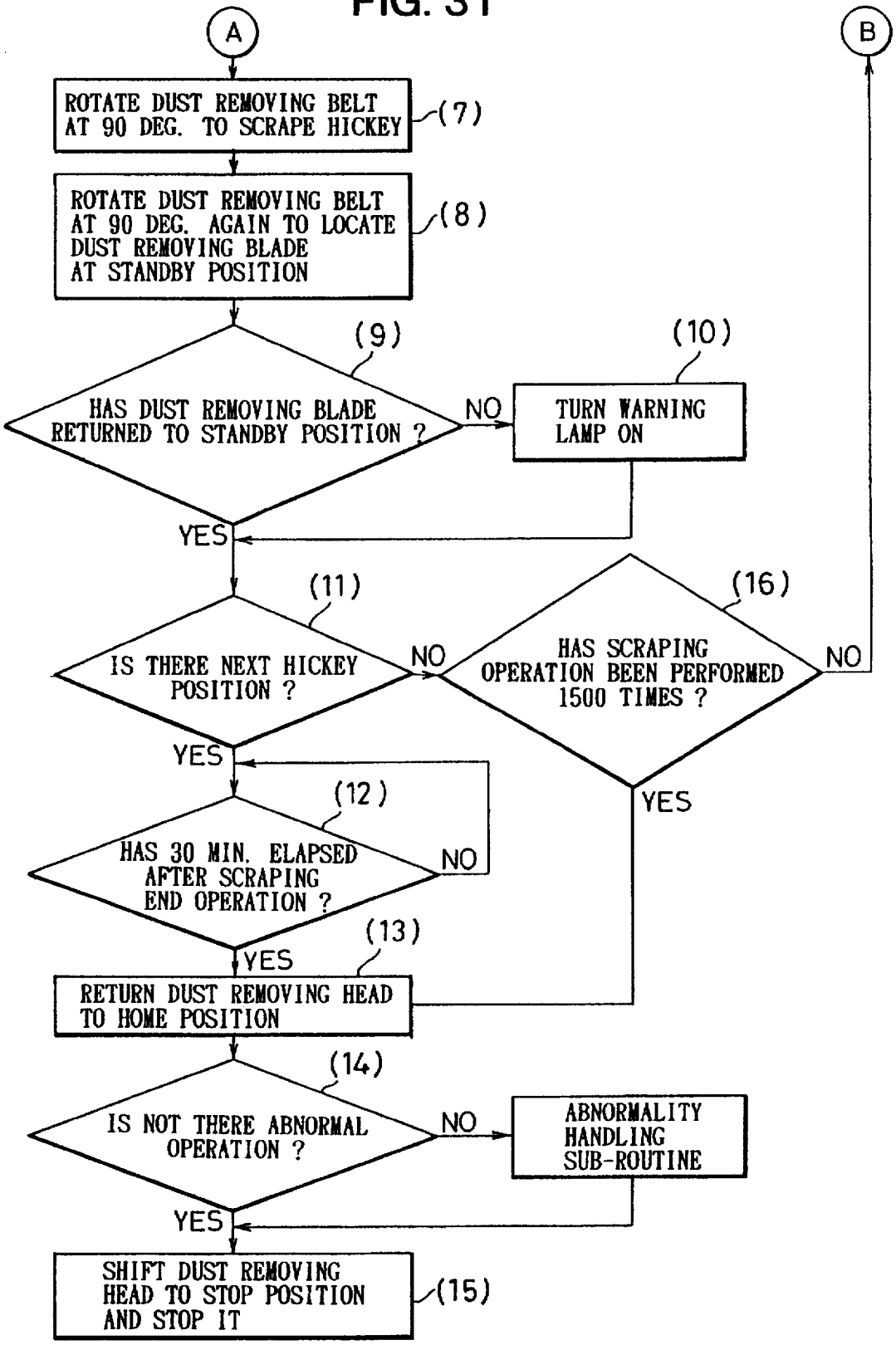
FIG. 31 is a flow chart showing the following procedures of the operation of FIG. 30.

Next, an operation of the controller 309 will be described with reference to a flow chart (FIGS. 30 and 31).

The controller 309 shifts the dust removing heads 204 of all the printing-plate dust removing apparatuses 203 to the home positions detected by the detecting sensors 242 when the power has switched on. Then, if a gap has been generated between the recognized position of the dust removing head 204 which is presumed by the controller 309 and the actual position of the dust removing head 204, the gap is corrected in an abnormality handling sub-routine (steps (1) to (3)). After confirming and correcting the gap, the controller 309 stops the dust removing heads 204 of all the printing-plate dust removing apparatuses 203 at the stop positions set by the operation of the dust removing indicator buttons 311 of the digitizer 310 (step (4)).

When the operator has specified a hickey position formed on a printing plate and the printing-plate dust removing apparatus 203 to be used with the dust removing indicator buttons 311 of the digitizer 310 and the dust removing apparatus selecting buttons 312, the controller 309 then selects the specified printing-plate dust removing apparatus 203 and shifts the dust removing head 204 of the selected printing-plate dust removing apparatus 203 to the specified position (steps (5) and (6)). The corresponding dust removing belt 210 of the above dust removing head 204 is then shifted intermittently so that the dust removing blades 211 are rotated at 90° to set one of the dust removing blades 211 to the working position (step (7)). In this step, a time period for holding the working position can be set. After the elapse of the holding time, the controller 309 further shifts the dust removing belt 210 so that the dust removing blades 211 are rotated at 90° again to set it to the standby position (step (8)).

Then, the blade position detecting device 308 detects whether the dust removing blades 211 are located at the standby positions and counts the number of times the dust removing blades 211 have been used (step (9)). If the dust removing blades 211 are not located at the standby positions, this situation is displayed by the warning lamp 314 (FIG. 29) of the digitizer 310 to induce the operator to correct the positions (step (10)).

When the dust removing blades 211 are located at the standby position, if the next hickey (dust) position generated on the printing plate is not specified by the dust removing indicator buttons 311 of the digitizer 310, the controller 309 then returns the slider 208 and the dust removing head 204 to the home position after the elapse of a predetermined time (e.g., 30 minutes) after the above hickey (dust) scraping operation. The gap between the presumed position and the actual position is confirmed and corrected, and the controller 309 then stops the slider 206 and the dust removing head 204 to the stop position (steps (11) to (15)).

After the hickey (dust) scraping, if the next hickey (dust) position generated on the printing plate is specified by the dust removing indicator buttons 311, the controller 309 then confirms of whether the dust removing blades 211 which will be next set to the working position are used a predetermined number of times (e.g., 30 times) (step (16)). If it is below the predetermined number of times, the controller 309 shifts the slider 206 and the dust removing head 204 to the next specified hickey (dust) scraping position to perform the dust scraping operation by using the dust removing blade 211 (step (6) to (8)). If it has reached the predetermined number of times, the controller 309 then stops the slider 206 and the dust removing head 204 at the stop position after they have been returned to the home position. This is then displayed by the warning lamp 314 (steps (13) to (15)).

According to the above embodiment, the guide rails 228 for guiding the slider 206 are formed inside the frame 217, and the second shielding plate 302 is provided on the rail frame 217 so as to extend obliquely in the lower direction relative to the guide rails 228. The first shielding plate 303 is also provided on the machine mount 229 supporting the rail frame 217 so as to be opposite to the guide rails 228. The guide rails 228 are covered with both the first and second shielding plates 302 and 303, therefore, the guide rails 228 are protected from getting stained with ink. Since the guide rails 228 and the slider 206 are protected from getting stained with ink, the slider 206 and the dust removing head 204 can be shifted smoothly.

The blade position detecting device 308 provided in the driving gear 305 detects that the dust removing blade 211 is located at a predetermined standby position where the blade 211 is isolated from the plate cylinder 201. The controller 309 outputs a signal to the driving gear 305 so that the dust removing blade 211 is shifted to the next position only when the detected signal d showing that the dust removing blade 211 is located at the above predetermined standby position has been inputted from the above blade position detecting device 308. Therefore, this shift of the dust removing blade 211 is stopped when the dust removing blade 211 is not located at the predetermined standby position. Accordingly, during the operation of the dust removing apparatus, the dust removing operation is accurately performed at the working position at any time, and failure in the dust removing operation can be easily determined. Also, a bad operation of the dust removing blades 211 will be brought to the attention of the operator by turning the warning lamp 314 on. This improves reliability.

Further, the blade position detecting device 308 provided in the driving gear 305 detects that the dust removing blade 211 is located at a predetermined standby positions where the blade is isolated from the plate cylinder 201, and the controller 309 outputs the shift pulse signal a to the moving device 230 so that the slider 206 is shifted only when the detected signal d showing that the dust removing blade 211 is located at the predetermined standby positions has been inputted from the blade position detecting device 308. If the dust removing blade 211 is not located at the standby position, the slider 206 is stopped. Accordingly, the dust removing head 204 is not shifted when one of the dust removing blade 211 is located at the working position where the blade 211 is in contact with the printing plate 202 on the plate cylinder 201. This makes it possible to prevent the printing plate 202 from being damaged by the dust removing blade 211. As a result, the reliability is improved.

Further, the controller 309 stops the slider 206 and the dust removing head 204 at the stop position memorized as an area which eliminates the both ends from the guide rails 228 when the dust removing operation is not performed. The slider 206 and the dust removing head 204 can be stopped within the area except for the ends of the guide member 228 where ink is intensively scattered. Accordingly, the slider 206 and the dust removing head 204 are prevented from getting excessively stained with ink and the shift of the slider 206 and the dust scraping operation of the dust removing belt 210 can be properly performed.

Further, the counter provided in the controller 309, in which the number of times the dust removing has been performed is counted by subtraction, inputs the detected signal d from the blade position detecting device 308 provided in the driving gear 306. The value counted by subtraction in the counter is displayed on the count display portion 313 of the digitizer 310, and this makes it possible to always known whether all the dust removing blades 211 on one dust removing belt 210 have been used for the dust removing predetermined times (e.g., 30 times). As a result, exchange timing of the dust removing belt 210 can be confirmed and this can prevent the dust removing blades 211 from being used over the predetermined limit of times so as to improve reliability on dust (hickey) scraping by use with the dust removing blades 211.

In addition, the rotational rate between the timing pulleys 209A, 209B and the pulley 214B may be set from 1 to an integral multiple.

INDUSTRIAL APPLICABILITY

As discussed above, an apparatus and system for removing dust from a printing plate of a printing press according the present invention have been used for removing hickey (dust) which has adhered to the printing plate on the plate cylinder of the printing press. However, it may be effectively used for removing hickey (dust) which has adhered to a blanket cylinder (rubber cylinder) placed adjacent to the plate cylinder.

What is claimed is:

1. An apparatus for removing dust from a printing plate of a printing press, the printing plate being provided on a surface of a plate cylinder rotatable about a plate cylinder axis, comprising:

a machine mount;

a guide member supported by the machine mount, being installed in parallel with the plate cylinder axis along a circumferential surface of the plate cylinder;

a slider for movement along said guide member;

a holder removably supported by said slider;

a moving member supported by said holder, the moving member having a plurality of dust removing blades arranged with predetermined equal pitches;

a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during a non-dust removing operation, wherein said driving gear includes a driving shaft supported by one of said machine mount and said slider, a driven shaft supported by said holder, a driving-side coupling member provided on an end of said driving shaft, and a driven-side coupling member provided on an end of said driven shaft, and wherein said driving-side coupling member is removably engaged with said driven-side coupling member.

2. The apparatus for removing dust from a printing plate of a printing press according to claim 1, wherein said driving-side coupling member has a first interlocking claw, said driven-side coupling member has a second interlocking claw capable of engaging with said first interlocking claw, the position of said second interlocking claw of said driven-side coupling member and the position of said dust removing blade of said moving member have a corresponding relationship, and said second interlocking claw is able to engage with said first interlocking claw only at a standby position of said moving member at which said dust removing blade is isolated from said plate cylinder in the condition that an intermittent rotation of said driving shaft is stopped.

3. The apparatus for removing dust from a printing plate of a printing press according to claim 1, wherein said holder is provided with a first wedge member and a receiving member, and wherein said slider is provided with a second wedge member capable of removably engaging with said first wedge member and a clamping member which is capable of clamping said receiving member, and said first and second wedge members are capable of firmly fitting by clamping said clamping member to said receiving member in a condition where said first and second wedge members are fitted to each other.

4. The apparatus for removing dust from a printing plate of a printing press according to claim 3, wherein said receiving member is a holder plate for guiding said clamping member when said holder is one of attached and detached, and said holder is provided with a separation-preventative member capable of preventing separation of said clamping member from said holder plate.

5. An apparatus for removing dust from a printing plate of a printing press, the printing plate being provided on a surface of a plate cylinder rotatable about a plate cylinder axis, comprising:

a machine mount;

a guide member supported by the machine mount, and installed in parallel with the plate cylinder axis along a circumferential surface of the plate cylinder:

a slider for movement along said guide member;

a holder supported by said slider;

a moving member having a pair of pulleys each of which is united with a supporting shaft through a locking member and supported by said holders through said supporting shafts and a belt wound around said pair of pulleys and having a plurality of dust removing blades arranged with equal pitches; and a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during a non-dust removing operation, wherein said holder is provided with guide grooves extending from edges to the inside at one side thereof, said supporting shaft of one of said pair of pulleys capable of insertion into said guide grooves, and wherein said holder is provided with supporting holes at the other side thereof, the supporting shaft of the other of said pair of pulleys capable of being fitted into said supporting holes.

6. An apparatus for removing dust from a printing plate of a printing press, the printing plate being provided on a surface of a plate cylinder rotatable about a plate cylinder axis, comprising:

a machine mount;

a guide member supported by the machine mount, being installed in parallel with the plate cylinder axis along a circumferential surface of the plate cylinder;

a slider for movement along said guide member;

a holder having a shaft and supported by said slider;

a moving member having a pair of pulleys supported by the shaft of said holder and a belt wound around said pair of pulleys at a respective diametrical inside of each pulley, said belt having a plurality of dust removing blades arranged with equal pitches; and a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during a non-dust removing operation, wherein said holder is provided with a guide member proximate to said pair of pulleys, respectively, for guiding said belt into each diametrical inside of said pulleys.

7. The apparatus for removing dust from a printing plate of a printing press according to claim 6, wherein said belt is a timing belt having teeth arranged with equal pitches on the back side thereof and said pair of pulleys is a pair of timing pulleys capable of engaging with the timing belt, and further comprising an anti-biting member disposed between said pair of timing pulleys and being supported by said holder, a size of said anti-biting member in the direction in which said timing belt moves being made longer than the pitch of said teeth of said timing belt so that said timing belt guided by said guide member and the other timing belt passing over said timing belt are prevented from biting each other.

8. An apparatus for removing dust from a printing plate of a printing press, the printing plate being provided on a surface of a plate cylinder rotatable about a plate cylinder axis, comprising:

a machine mount;

a rail frame provided with a pair of guide rails supported by the machine mount, and being installed in parallel with the plate cylinder axis along a circumferential surface of the plate cylinder;

a slider for movement along said guide rails;

a holder supported by said slider;

a moving member supported by said holder and having a plurality of dust removing blades arranged with equal pitches; and a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during a non-dust removing operation, wherein said guide rails are formed inside said rail frame.

9. The apparatus for removing dust from a printing plate of a printing press according to claim 8 further comprising a first shielding member disposed on said machine mount in oppositition to said guide rails and extending towards said plate cylinder in the longitudinal direction of said guide rails, and a second shielding member disposed on said rail frame so as to extend obliquely towards said first shielding member, the second shielding member made of a flexible material so as to be moved upwards by said holder, and disposed in the longitudinal direction of said guide rails.

10. A system for removing dust from a printing plate of a printing press, the printing plate being provided on a surface of a plate cylinder rotatable about a plate cylinder axis, comprising:

a machine mount;

a guide member supported by the machine mount and being installed in parallel with the plate cylinder axis along a circumferential surface of the plate cylinder;

a slider for movement along said guide member;

a moving device for moving said slider;

a holder supported by said slider;

a moving member supported by said holder and having a plurality of dust removing blades arranged with equal pitches;

a driving gear for shifting said moving member intermittently between a predetermined standby position where none of the dust removing blades contacts the printing plate of the plate cylinder and a position where one of the dust removing blades contacts the printing plate of the plate cylinder;

a detecting means provided in the driving gear for detecting that the corresponding dust removing blade is in the predetermined standby position where the blade is isolated from the plate cylinder said means outputting the detected signal to a controller; and a controller for controlling said driving gear and said moving device by transmitting a signal to said driving gear so as to shift the dust removing blade to a next position only when the detected signal from said detecting means is inputted to said controller.

11. A system for removing dust from a printing plate of a printing press, the printing plate being provided on a surface of a plate cylinder rotatable about a plate cylinder axis, comprising:

a machine mount;

a guide member supported by the machine mount, being installed in parallel with the plate cylinder axis along a circumferential surface of the plate cylinder;

a slider for movement along said guide member;

a moving device for moving said slider;

a holder supported by said slider;

a moving member supported by said holder and having a plurality of dust removing blades arranged with equal pitches;

a driving gear for shifting said moving member intermittently between a predetermined standby position where none of the dust removing blades contacts the printing plate of the plate cylinder and a position where one of the dust removing blades contacts the printing plate of the plate cylinder;

a detecting means provided in the driving gear for detecting that the corresponding dust removing blade is in the predetermined standby position where the blade is isolated from the plate cylinder, said means outputting the detected signal to a controller; and a controller for controlling said driving gear and said moving device by transmitting a signal to said moving device so as to shift said slider only when the detected signal for informing that the blade is located at the predetermined standby position is inputted from said detecting means to said controller.

12. A system for removing dust from a printing plate of a printing press, the printing plate being provided on a surface of a plate cylinder rotatable about a plate cylinder axle, comprising:

a machine mount;

a guide member supported by the machine mount installed in parallel with the plate cylinder axis along a circumferential surface of the plate cylinder;

a slider for movement along said guide member;

a moving device for moving said slider;

a holder supported by said slider:

a moving member supported by said hold and having a plurality of dust removing blades arranged with equal pitches;

a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during non-dust removing operation;

a detecting sensor fixed on the machine mount for detecting and signaling that said slider comes to a predetermined position and to output the detected signal; and a controller for presuming a slider position to determine a presumed position and setting said slider to a target position on the basis of the presumed position, wherein said controller compares an actual position of said slider determined in accordance with said detected signal outputted from said detecting sensor with said presumed position of said slider that is under recognition so that a deviation between the actual and presumed positions is corrected to enable the presumed position to coincide with said actual position.

13. The system for removing dust from a printing plate of a printing press according to claim 12, wherein said controller stops said slider in an area except end portions of said guide members that are not opposite said plate cylinder when the dust removing operation is not performed.

14. A system for removing dust from a printing plate of a printing press, the printing plate being provided on a surface of a plate cylinder rotatable about a plate cylinder axis, comprising:

a machine mount;

a guide member supported by the machine mount and installed in parallel with the plate cylinder axis along a circumferential surface of the plate cylinder;

a slider for movement along said guide member;

a moving device for moving said slider;

a holder supported by said slider;

a moving member supported by said holder and having a plurality of dust removing blades arranged with equal pitches;

a driving gear for shifting said moving member intermittently, the driving gear positioning one of the dust removing blades into contact with the printing plate of the plate cylinder during a dust removing operation, and the driving gear positioning the dust removing blade so as to be isolated from the plate cylinder during a non-dust removing operation;

a controller for controlling said driving gear and said moving device;

a counter provided on said controller for counting the number of times said moving member has performed the dust removing operation; and a display device for displaying the value counted by said counter.

15. An apparatus for removing dust from a printing plate of a printing press, the printing plate being provided on a surface of a plate cylinder rotatable about a plate cylinder axis, comprising:

a machine mount;

a guide member supported by the machine mount, being installed in parallel with the plate cylinder axis along a circumferential surface of the plate cylinder;

a slider for movement along said guide member;

a holder supported by said slider;

a moving member supported by said holder and having a plurality of dust removing blades arranged with equal pitches; and a driving gear for shifting said moving member intermittently, the driving gear positioning one of the dust removing blades into contact with the printing plate of the plate cylinder during dust removing operation, and the driving gear positioning the dust removing blade so as to be isolated from the plate cylinder during a non-dust removing operation, wherein said moving member has a timing belt having a multiplicity of teeth formed on a back side of said timing belt at equal pitches and a plurality of said dust removing blades formed on a front side of said timing belt, said dust removing blades provided at positions corresponding to the tops of the teeth of said timing belt, said dust removing blades each having a width smaller than the pitches of said teeth.

* * * * *